US008135312B2

(12) United States Patent
Kohno et al.

(10) Patent No.: US 8,135,312 B2
(45) Date of Patent: Mar. 13, 2012

(54) DEVELOPMENT APPARATUS AND IMAGE FORMING APPARATUS

(75) Inventors: Hirohisa Kohno, Ebina (JP); Kazunori Koshimori, Saitama (JP); Kei Hirata, Ebina (JP); Akihide Kawamura, Ebina (JP); Naoya Iwata, Hadano (JP); Keisuke Kubo, Ebina (JP); Takashi Sakamoto, Ebina (JP); Taiyou Uehara, Ebina (JP); Toshikazu Tsumita, Ebina (JP); Takeshi Okoshi, Ebina (JP); Tomio Onuki, Ebina (JP)

(73) Assignee: Fuji Xerox Co., Ltd, Tokyo (JP)

( * ) Notice: Subject to any disclaimer, the term of this patent is extended or adjusted under 35 U.S.C. 154(b) by 714 days.

(21) Appl. No.: 12/128,665

(22) Filed: May 29, 2008

(65) Prior Publication Data

US 2009/0129820 A1 May 21, 2009

(30) Foreign Application Priority Data

Nov. 16, 2007 (JP) ..... 2007-298421
Nov. 16, 2007 (JP) ..... 2007-298423

(51) Int. Cl.
*G03G 15/08* (2006.01)

(52) U.S. Cl. ..... 399/254; 399/267

(58) Field of Classification Search ..... 399/254, 399/356

See application file for complete search history.

(56) References Cited

U.S. PATENT DOCUMENTS 5,592,270 A * 1/1997 Takai et al. ..... 399/260
2007/0166079 A1* 7/2007 Ichikawa et al. ..... 399/254
2008/0056772 A1* 3/2008 Utsumi et al. ..... 399/254

FOREIGN PATENT DOCUMENTS

| | | | |
|---|---|---|---|
| JP | 10-083110 | A | 3/1998 |
| JP | 11-065216 | A | 3/1999 |
| JP | 2001-209244 | A | 8/2001 |
| JP | 2004-252174 | A | 9/2004 |
| JP | 2005-049900 | A | 2/2005 |
| JP | 2005-189253 | A | 7/2005 |

OTHER PUBLICATIONS

Japanese Office Action for JP Appln. No. 2007-298423 dated Dec. 20, 2009 and English-language translation.

* cited by examiner

*Primary Examiner* — David Gray
*Assistant Examiner* — Roy Y Yi
(74) *Attorney, Agent, or Firm* — Sughrue Mion, PLLC

(57) ABSTRACT

There is provided a development apparatus including: a first developer storage container and a second developer storage container that store developer, having a first a and second openings, respectively; a first transport member provided within the first developer storage container, and that causes the developer to move to the second developer storage container via the first opening; a second transport member provided within the second developer storage container, and that causes the developer to move to the first developer storage container via the second opening; a developer holding member that performs development by causing the developer to move to a position facing an image holding body on which a latent image is formed; and a moving member provided so as to fit between an inner wall face of the second developer storage container and an outer edge of the second transport member.

28 Claims, 21 Drawing Sheets

DEVELOPMENT APPARATUS AND IMAGE FORMING APPARATUS

CROSS-REFERENCE TO RELATED APPLICATIONS

This application is based on and claims priority under 35 U.S.C. 119 from Japanese Patent Applications No. 2007-298421 and No. 2007-298423, which were filed on Nov. 16, 2007.

BACKGROUND

1. Technical Field

The present invention relates to a development apparatus and an image forming apparatus.

2. Related Art

Two-component development methods, in which development is performed while stirring and transporting a two-component developer that includes a toner and a carrier in a development apparatus, are widespread. Technology is known in which, in such a two-component development method, in order to prevent deterioration of developer due to the developer being stirred in the development apparatus over a long period of time, excess developer is discharged from a discharge port while new developer is replenished from a developer supply port.

SUMMARY

In an aspect of the present invention, there is provided a development apparatus including: a first developer storage container and a second developer storage container that store developer, the first developer storage container having a first opening and a second opening, so that the first developer storage container and the second developer storage container are in communication; a first transport member that is provided within the first developer storage container, and that by rotating around a center of rotation, while transporting developer stored in the first developer storage container, causes the developer to move to the second developer storage container via the first opening; a second transport member that is provided within the second developer storage container, and that by rotating around a center of rotation, while transporting developer stored in the second developer storage container, causes the developer to move to the first developer storage container via the second opening; a developer holding member that holds developer supplied from the first developer storage container or the second developer storage container, and performs development by causing the developer to move to a position facing an image holding body on which a latent image is formed; and a moving member that is provided so as to fit between an inner wall face of the second developer storage container and an outer edge of the second transport member, and is moved between a first position where the second opening is covered and a second position where the second opening is not covered, and when moved to the second position, covers the inner wall face, viewed from the lowermost position in the second developer storage container, on the downstream side in the direction of rotation of the second transport member and on the side below the center of rotation of the second transport member in the direction of gravity.

BRIEF DESCRIPTION OF THE DRAWINGS

Exemplary embodiments of the present invention will be described in detail based on the following figures, wherein.

DETAILED DESCRIPTION

1. First Exemplary Embodiment

Configuration of Image Forming Apparatus

Figure 1:
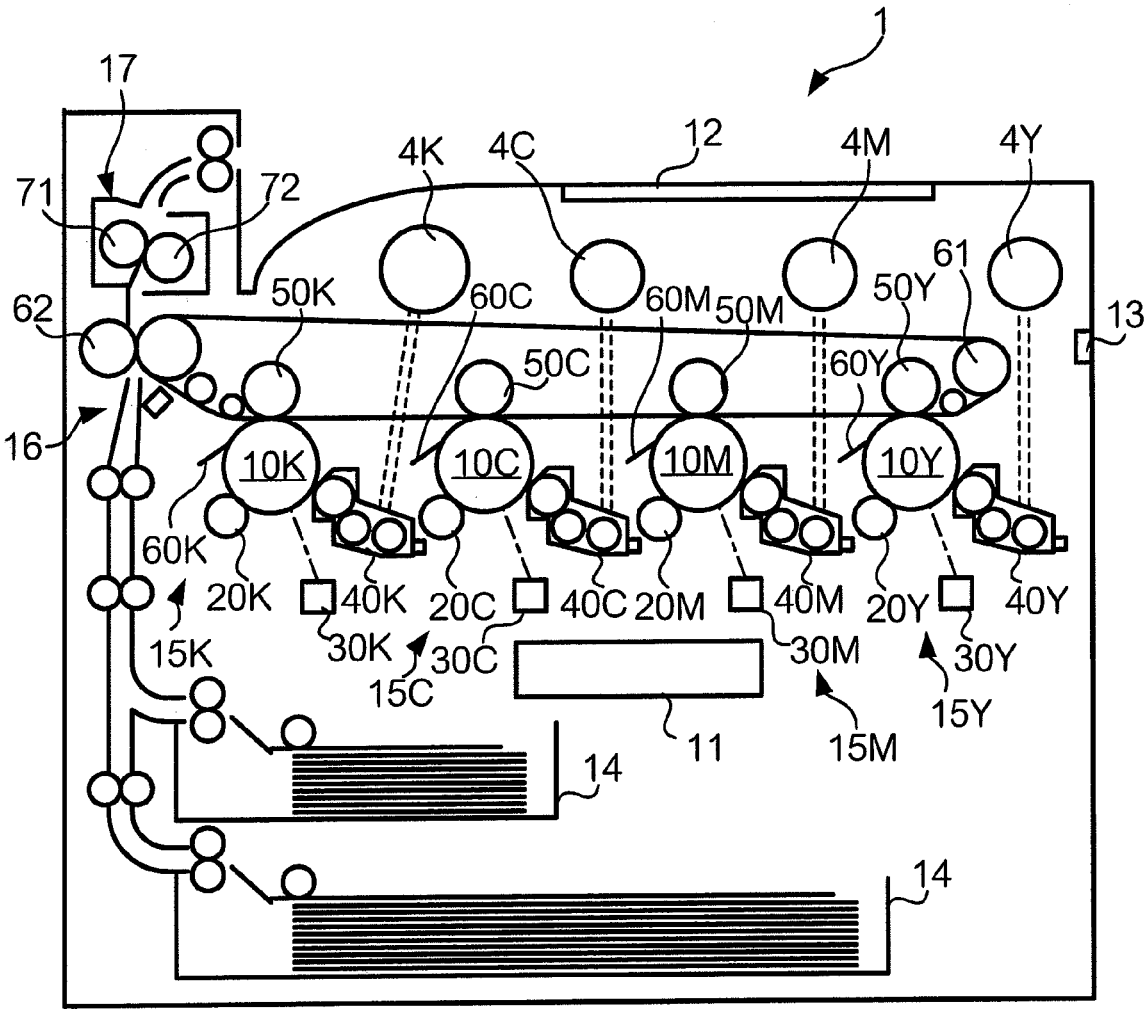
FIG. 1 shows the configuration of an image forming apparatus according to a first exemplary embodiment.

FIG. 1 shows the configuration of an image forming apparatus 1 according to this exemplary embodiment. This image forming apparatus 1 performs image forming by a so-called tandem method. As shown in FIG. 1, the image forming apparatus 1 is provided with a controller 11, a display operation unit 12, a communications unit 13, a paper storage unit 14, image forming units 15Y, 15M, 15C, and 15K, a transfer unit 16, and a fixing unit 17. Note that in the description and drawings of this exemplary embodiment, a configuration with reference symbols including the letters "Y", "M", "C", and "K" means a configuration for making an image using developers of each of the respective colors yellow (Y), magenta (M), cyan (C), and black (K).

The controller 11 is provided with a CPU (Central Processing Unit) and a memory, and controls each part of the image forming apparatus 1 by the CPU executing a program stored in the memory. The display operation unit 12 is provided with a touch panel and operation buttons, displays images according to instructions of the controller 11, and supplies operation signals according to operation by a user to the controller 11. The communications unit 13 acquires image data or the like from a computer apparatus connected via a network, and supplies this acquired image data to the controller 11. The paper storage unit 14 stores paper that is cut to a predetermined size such as A3 or A4. The paper stored in the paper storage unit 14 is taken out page by page according to an instruction of the controller 11, and transported to a secondary transfer roller 62 of the transfer unit 16 via a paper transport path.

The image forming units 15Y, 15M, 15C, and 15K are disposed in a line along an intermediate transfer belt 61 of the transfer unit 16, and form a toner image corresponding to image data supplied by the controller 11. The image forming units 15Y, 15M, 15C, and 15K are each provided with the same configuration, so here their configuration will be specifically described using the image forming unit 15Y as an example.

The image forming unit 15Y is provided with a photosensitive drum 10Y, a charger 20Y, an exposure unit 30Y, a development apparatus 40Y, a primary transfer roller 50Y, and a cleaning member 60Y. The photosensitive drum 10Y is an image holding body on which a toner image is formed, and is rotated by an unshown drive unit. The charger 20Y uniformly charges the surface of the photosensitive drum 10Y. The exposure unit 30Y irradiates laser light corresponding to the image data onto the surface of the charged photosensitive drum 10Y to form an electrostatic latent image. A two-component developer that includes a toner and a carrier and is supplied from a developer supply unit 4Y is stored in the development apparatus 40Y. By transporting this developer while stirring the developer, the development apparatus 40Y affixes toner to the photosensitive drum 10Y on which the electrostatic latent image is formed, thereby forming a toner image. Thus, the electrostatic latent image that is formed on the surface of the photosensitive drum 10Y is developed. The primary transfer roller 50Y, due to a potential difference relative to the photosensitive drum 10Y, causes the toner image formed on the surface of the photosensitive drum 10Y to be transferred to the intermediate transfer belt 61. The cleaning apparatus 60Y removes toner remaining on the photosensitive drum 10Y after the toner image is transferred.

The transfer unit 16 is provided with the intermediate transfer belt 61 and the secondary transfer roller 62. The intermediate transfer belt 61 is caused to revolve by an unshown drive roller, and transports toner images transferred in a superimposed manner by the above-described primary transfer rollers 50Y, 50M, 50C, and 50K to the secondary transfer roller 62. The secondary transfer roller 62, due to a potential difference relative to the intermediate transfer belt 61, causes the toner images formed on the intermediate transfer belt 61 to be transferred to paper that is transported from the paper storage unit 14. The fixing unit 17 is provided with a hot roller 72 and a pressure roller 71, and fixes the toner images by applying heat and pressure to the paper that is transported from the secondary transfer roller 62. The paper on which the toner images have been fixed is transported to a paper discharge port via the paper transport path, and discharged from the paper discharge port.

Configuration of Development Apparatuses

Next is a description of the configuration of the development apparatus 40Y, and development apparatuses 40M, 40C, and 40K. The development apparatuses 40Y, 40M, 40C, and 40K are each provided with the same configuration, so here their configuration will be specifically described using the development apparatus 40Y as an example. Also, in the following description, when it is not particularly necessary to distinguish between the development apparatuses 40Y, 40M, 40C, and 40K, they will be collectively referred to as the "development apparatus 40".

Figure 2:
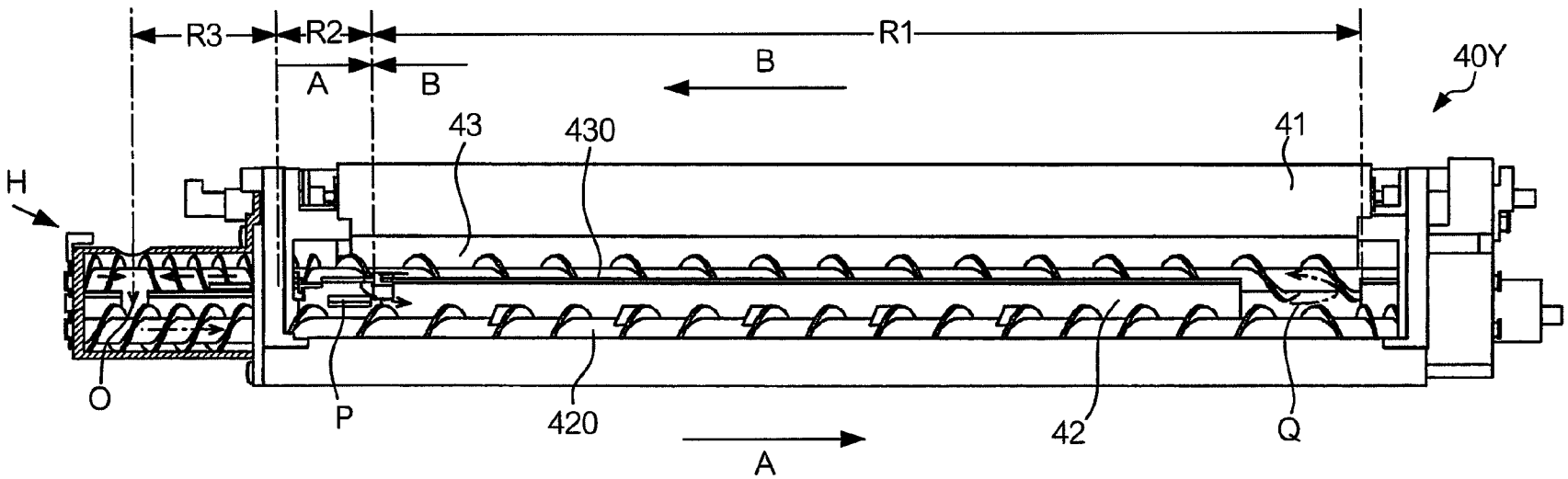
FIG. 2 is a plan view in which a development apparatus is viewed from above, with a cover that covers the top of the development apparatus removed.

FIG. 2 is a plan view in which the development apparatus 40Y is viewed from above, with a cover that covers the top of the development apparatus 40Y removed. Note that only the left portion in FIG. 2 is a cross-sectional view. As shown in FIG. 2, the development apparatus 40Y is provided with a development roller 41, a developer storage compartment 42, and a developer storage compartment 43. The development roller 41 is disposed in the vicinity of the developer storage compartment 43, and is provided such that a portion of the development roller 41 is exposed on the side of the photosensitive drum 10Y. The developer storage compartment 42 and the developer storage compartment 43 are adjacent, and are in communication via an opening portion Q and an opening portion P serving as first opening portions, and an opening portion O serving as a second opening portion.

The development roller 41 attracts carrier included in developer of the developer storage compartment 43 using magnetic force, and due to being rotated by an unshown drive unit, transports that carrier to a development region that faces the photosensitive drum 10Y. At this time, toner included in the developer is affixed to the carrier. When the toner affixed to the carrier is transported to the development region in a state of being held on the development roller 41, that toner moves to the side of the photosensitive drum 10Y due to a potential difference relative to the electrostatic latent image on the photosensitive drum 10Y. Thus, the electrostatic latent image that is formed on the surface of the photosensitive drum 10Y is developed. That is, the development roller 41 serves as a developer holding body that holds developer supplied from the developer storage compartment 43, and performs development by causing that developer to move to a position that faces the photosensitive drum 10Y on which the electrostatic latent image is formed.

The developer storage compartment 42 is a cylindrical member that extends in a direction parallel to the axial direction of the development roller 41, and is a first developer storage compartment in which the developer including the toner and the carrier is stored. Inside of the developer storage compartment 42, a transport member 420 in which spiral blades are provided around a rotating shaft is provided as a first transport member. This transport member 420, due to its rotating shaft being rotated by an unshown drive unit with the shaft center as the center of rotation, transports the developer stored by the developer storage compartment 42 in the direction of arrow A in FIG. 2, while stirring that developer. The developer transported by the transport member 420 moves to the developer storage compartment 43 via the opening portion Q.

The developer storage compartment 43, like the above-described developer storage compartment 42, is a cylindrical member that extends in a direction parallel to the axial direction of the development roller 41, and is a second developer storage compartment in which the developer including the toner and the carrier is stored. Inside of the developer storage compartment 43, a transport member 430 in which spiral blades are provided around a rotating shaft is provided as a second transport member. The developer storage compartment 43 has a transport region R1 where developer is transported and supplied to the development roller 41, an accumulation region R2 where developer is caused to move from the opening portion P to the developer storage compartment 42, and a discharge region R3 for discharging developer. The direction of the blades of the transport member 430 in the accumulation region R2 is partially reversed from the direction in the transport region R1. The transport member 430 is rotated by an unshown drive unit with the rotating shaft as the axial center, but because the direction of the blades of the transport member 430 is reversed, in the transport region R1, developer stored in the developer storage compartment 43 is transported in the direction of arrow B in FIG. 2 while the developer is stirred, and in the accumulation region R2, the developer is transported in the direction opposite to the direction of arrow B, i.e. the developer is transported in the direction of arrow A.

In the transport region R1, the developer stored in the developer storage compartment 43 is transported by the transport member 430 in the direction of arrow B in FIG. 2 while being stirred, and supplied to the surface of the development roller 41. At this time, developer that has not been supplied to the development roller 41 is transported as-is to the residence region R2. The developer that is transported to the residence region R2 is pushed back in the direction opposite to the direction in which the developer is transported up to then by the transport member 430, and thus that developer moves to the developer storage compartment 42 via the opening portion P. Also, in the vicinity of the opening portion Q as well, by the same principle as in the vicinity of the opening portion P, developer that has up to then been transported by the transport member 420 moves to the developer storage compartment 43 via the opening portion Q. In this way, developer that is stored in the development apparatus 40Y circulates between the developer storage compartment 42 and the developer storage compartment 43.

Figure 3:
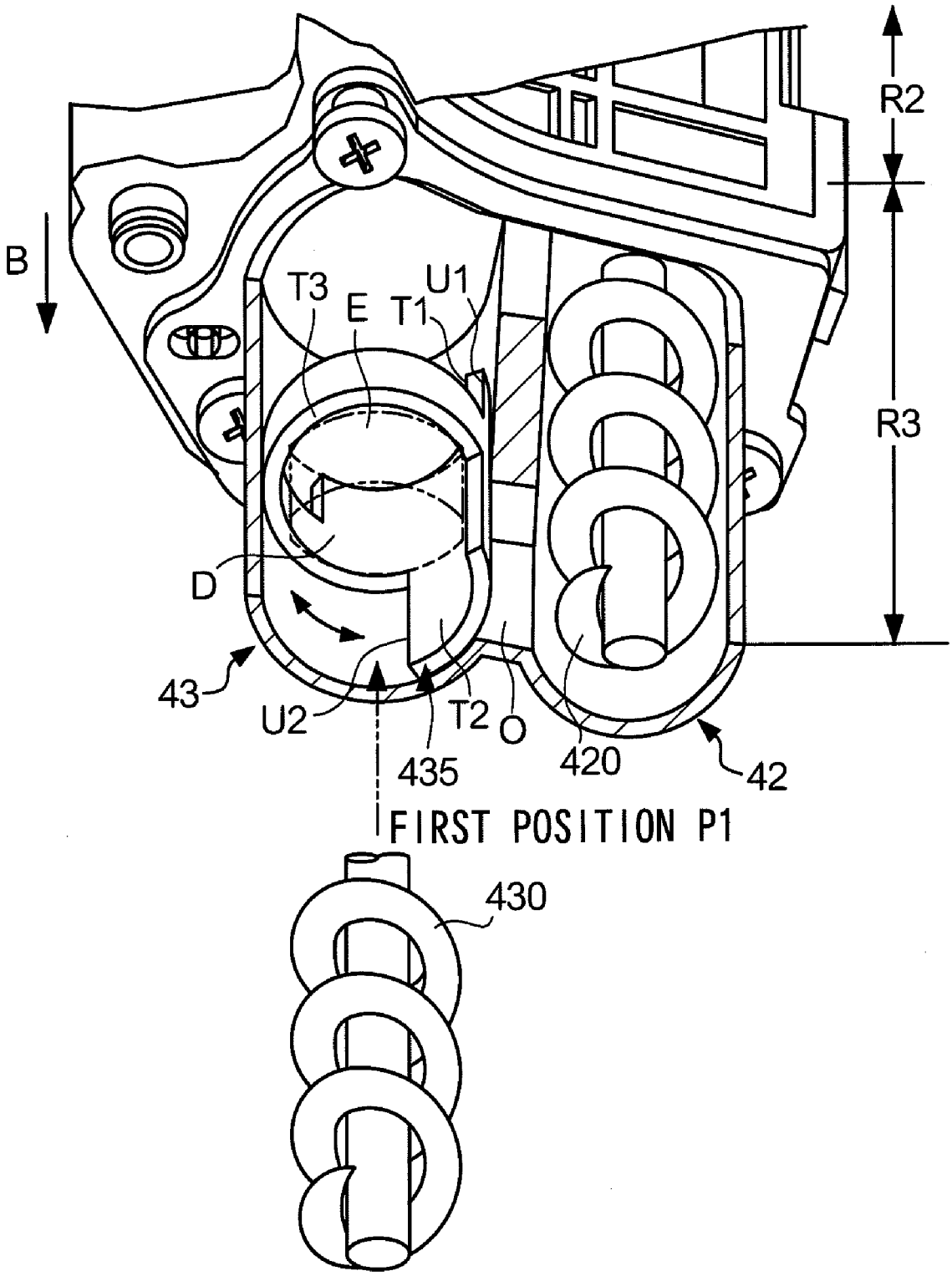
FIG. 3 is a cross-sectional view of a discharge region of a developer storage compartment.

FIG. 3 is a cross-sectional view of the discharge region R3 of the developer storage compartment 43, viewed from direction H indicated in FIG. 2. In FIG. 3, in order to facilitate understanding of the description, the transport member 430 is shown outside of the developer storage compartment 43, but actually the transport member 430 is provided inside of the developer storage compartment 43, as shown in FIG. 2. As shown in FIG. 3, a developer supply port E is provided in the upper part of the discharge region R3 of the developer storage compartment 43, a discharge port D is provided in the lower part of the discharge region R3, and furthermore a shutter 435 for opening and closing the discharge port D and the opening portion O is provided in the vicinity of the developer supply port E and the discharge port D. The developer supply port E is an opening portion that receives supply of developer from the developer supply unit 4Y. Developer that is supplied into the developer storage compartment 43 via the developer supply port E is pushed in the direction of the opening portion O by the transport member 430 that rotates, and moves to the developer storage compartment 42 via the opening portion O.

The discharge port D is an opening portion where excess developer is discharged when the developer stored within the development apparatus 40 is at least a predetermined amount. In the above-described accumulation region R2, when the developer stored within the development apparatus 40Y is at least a predetermined amount, the excess developer passes over developer that is pushed back by the transport member 430, and flows into the discharge region R3. Developer that has flowed into the discharge region R3 is transported in the direction of arrow B in FIG. 3 by the transport member 430, and discharged outside of the development apparatus 40Y from the discharge port D.

Configuration and Operation of Shutter

Figure 4:
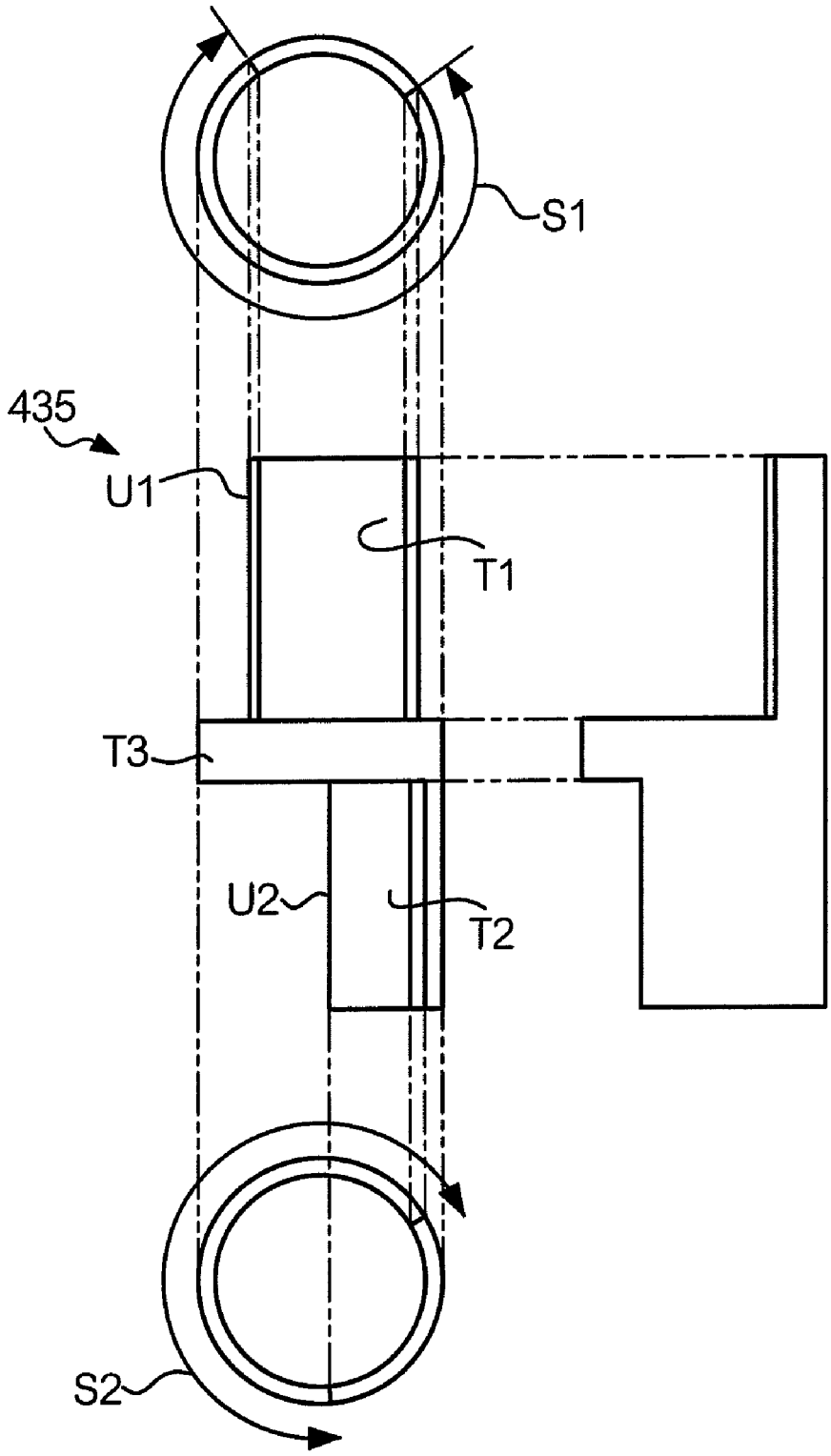
FIG. 4 is a plan view or elevation view of a shutter when viewed from four directions.

Next is a description of the configuration and operation of the shutter 435. The shutter 435 is a moving member provided along the inner wall face of the developer storage compartment 43, and the thickness of the shutter 435 is such that the shutter 435 fits between the inner wall face of the developer storage compartment 43 and the outer edge of the blades of the transport member 430. Here, FIG. 4 is a plan view or elevation view of the shutter 435 in the position shown in FIG. 3 when viewed from four directions. As shown in FIG. 4, the shutter 435 is provided with a protruding portion T1, a protruding portion T2, and a ring portion T3. The ring portion T3 is a ring-shaped member having an outer shape that is the same or slightly smaller than the inner diameter of the developer storage compartment 43. The protruding portion T1 and the protruding portion T2 are provided at both ends of the ring portion T3 and extend in a direction parallel to the developer transport direction. The protruding portion T1 is at least as large as the discharge port D shown in FIG. 3. Also, a region where, viewed from the ring portion T3, the protruding portion T1 is not provided (a region corresponding to S1 in FIG. 4) is also at least as large as the discharge port D. Below, this region is referred to as a cut-out portion U1. The protruding portion T2 is at least as large as the opening portion O shown in FIG. 3. Also, a region where, viewed from the ring portion T3, the protruding portion T2 is not provided (a region corresponding to S2 in FIG. 4) is also at least as large as the opening portion O. Below, this region is referred to as a cut-out portion U2.

Figure 5:
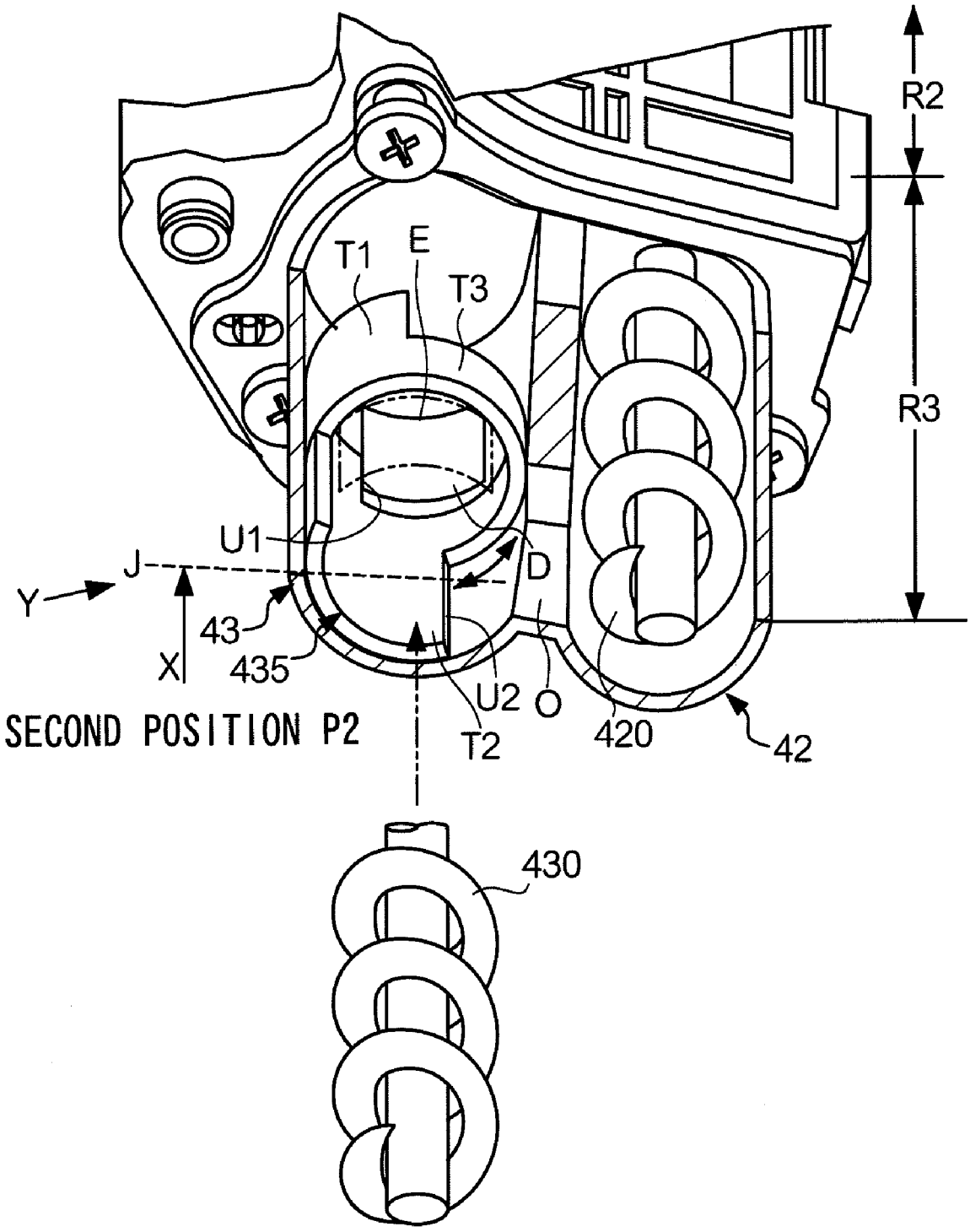
FIG. 5 shows the shutter when it is moved to another position.

An operation unit such as a lever that can be operated by an operator is linked to the shutter 435, and due to this operation portion being operated, the shutter 435 rotationally moves along the inner wall face of the developer storage compartment 43. FIG. 5 shows the shutter 435 when it is moved from the position shown in FIG. 3 to another position. Here, the position of the shutter 435 shown in FIG. 3 is called a first position P1, and the position of the shutter 435 shown in FIG. 5 is called a second position P2.

While the development apparatus 40 is operating, the shutter 435 is moved to the second position P2 shown in FIG. 5. At this time, the cut-out portion U1 of the shutter 435 is disposed at a position where it overlaps the discharge port D, so the discharge port D is in an open state facing toward the outside of the development apparatus 40. Also, at this time, the cut-out portion U2 of the shutter 435 is disposed at a position where it overlaps the opening portion O, so the opening portion O is in an open state facing toward the developer storage compartment 42. Thus, excess developer will be discharged from the discharge port D, and developer supplied to the developer supply port E will be allowed to move to the developer storage compartment 42 via the opening portion O.

On the other hand, for example, when the operation unit is operated by an operator when performing maintenance work, the shutter 435 is rotationally moved along the inner wall face of the developer storage compartment 43 and thus moved to the first position P1 shown in FIG. 3. At this time, the protruding portion T1 of the shutter 435 is moved to a position where it covers the discharge port D, so the discharge port D is in a closed state facing toward the outside of the development apparatus 40. Also, at this time, the protruding portion T2 of the shutter 435 is moved to a position where it covers the opening portion O, so the opening portion O is in a closed state facing toward the developer storage compartment 42. Thus, developer does not leak from the discharge port D to the outside of the development apparatus 40, and developer or other foreign matter does not enter from the developer storage compartment 43 via the opening portion O to the developer storage compartment 42.

Here, the operation of the shutter 435 in the second position P2 will be described in more detail. As described above, in the second position P2, the shutter 435 exhibits an operation of allowing developer that is supplied to the developer supply port E to move to the side of the opening portion O, and an operation of allowing excess developer to move to the side of the discharge port D.

Figure 6:
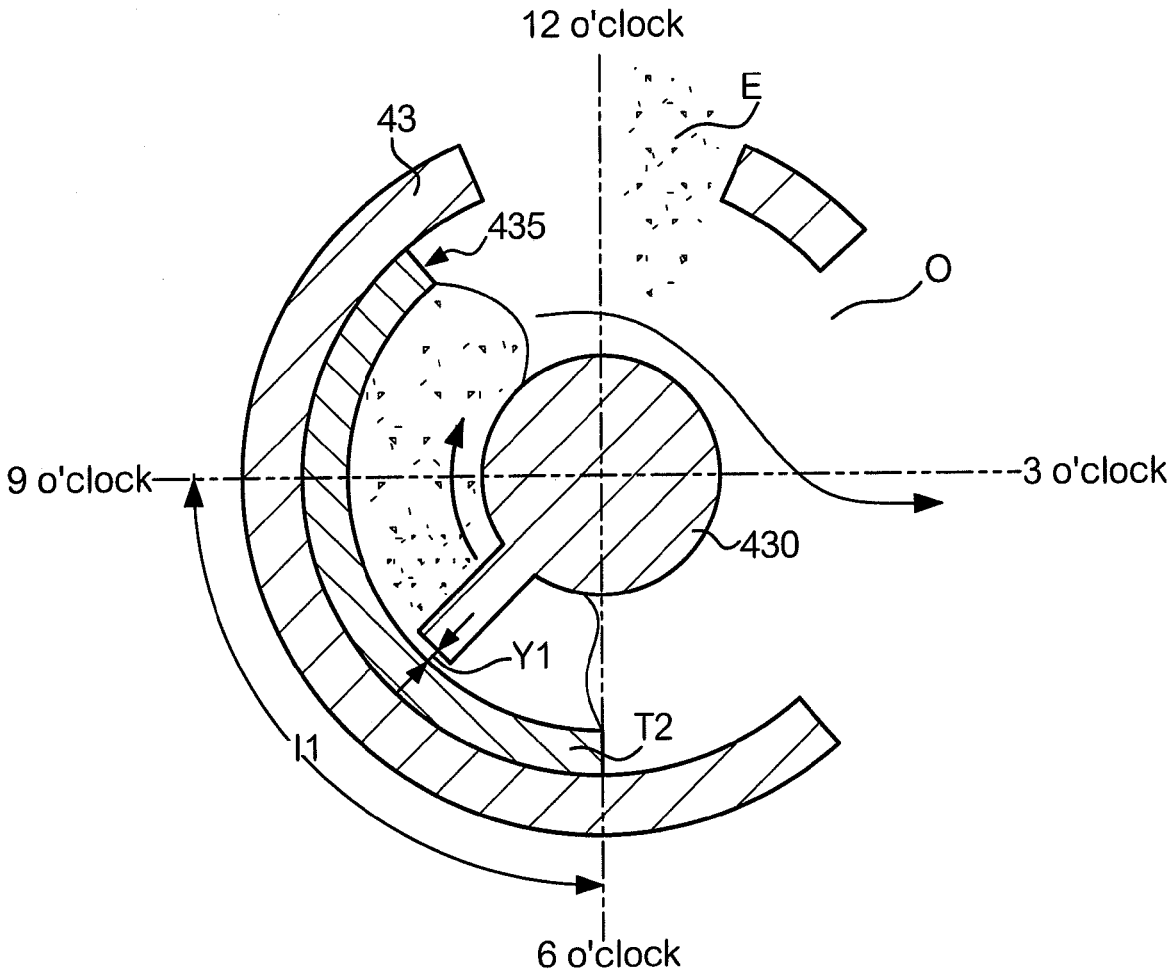
FIG. 6 illustrates an operation of moving developer to an opening portion side.

First is a description of the operation of allowing developer that is supplied to the developer supply port E to move to the side of the opening portion O, with reference to FIG. 6. FIG. 6 is a cross-sectional view in which the developer storage compartment 43 is viewed from the direction of arrow X at broken line J shown in FIG. 5. As shown in FIG. 6, in this developer storage compartment 43, the inner wall face at a position facing the opening portion O is a developer accumulation region I1. The developer accumulation region I1 is a position where developer that is supplied via the developer supply port E easily accumulates when the transport member 430 is rotating clockwise in FIG. 6.

As described above, developer that is supplied to the developer supply port E is transported to the side of the opening portion O by rotation of the transport member 430 that rotates, and moves to the developer storage compartment 42 via the opening portion O. At this time, the transport member 430 rotates clockwise, so after the blades of the transport member 430 move developer in the region on the right side in FIG. 6 to the left side, the developer is lifted upward and transported to the side of the opening portion O. Developer that, while being lifted upward in the direction of gravity by the transport member 430, has rolled over and fallen from the blades of the transport member 430 due to the operation of gravity, falls as-is to the lower left side of the storage space of the developer storage compartment 43. Thus, developer easily accumulates at the inner wall face between the 6 o'clock direction and the 9 o'clock direction in FIG. 6, which is a region to the lower left side of the storage space of the developer storage compartment 43, i.e. on the downstream side in the direction of rotation of the transport member 430 and on the side below the center of the transport member 430 in the direction of gravity. The developer accumulation region I1 can be obtained by testing, by calculation, or the like.

When the shutter 435 is moved to the second position P2, the protruding portion T2, as shown in FIG. 6, is disposed so as to cover the inner wall face of the developer accumulation region I1. Thus, in the developer accumulation region I1, in comparison to a case where the shutter 435 is not provided in such a position, a gap Y1 between the shutter 435, which forms the inner wall face of the developer storage compartment 43, and the transport member 430 is small. Thus, the space where developer supplied to the developer supply port E accumulates is small, and so it is possible to quickly cause this developer to move to the side of the opening portion O.

Figure 7:
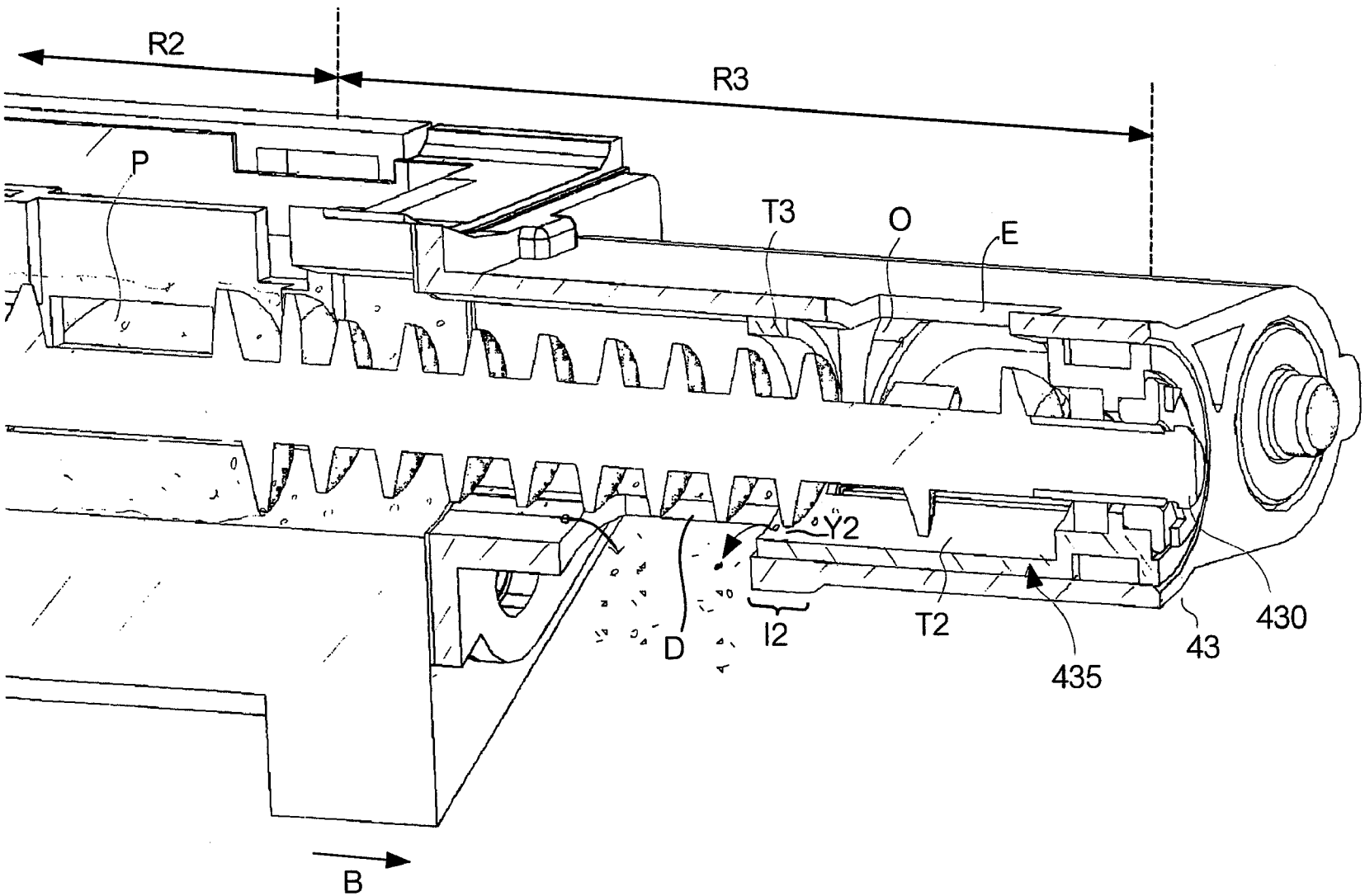
FIG. 7 illustrates an operation of moving excess developer to a discharge port side.

Next is a description of the operation of allowing excess developer to move to the side of the discharge port D, with reference to FIG. 7. FIG. 7 is a cross-sectional view in which the developer storage compartment 43 shown in FIG. 5 is viewed from the direction of arrow Y in FIG. 5. As described above, excess developer is transported in the direction of arrow B in FIG. 7 by the transport member 430, and discharged outside of the development apparatus 40Y from the discharge port D. However, included in the developer transported by the transport member 430 is developer that accumulates at a developer accumulation region I2 in FIG. 7 without being discharged from the discharge port D.

When the shutter 435 is moved to the second position P2, the ring portion T3, as shown in FIG. 7, is disposed so as to cover the inner wall face of the developer storage compartment 43 in the developer accumulation region I2. Thus, in the developer accumulation region I2, in comparison to a case where the shutter 435 is not provided in such a position, a gap Y2 between the shutter 435, which forms the inner wall face of the developer storage compartment 43, and the transport member 430 is small. Thus, the space where developer transported as developer to be discharged accumulates is eliminated, so it is possible to reduce the amount of that developer that accumulates, and as a result it is possible to allow developer to quickly move from the discharge port D to outside of the development apparatus 40.

Here, a case is provisionally considered in which the shutter 435 is not provided so as to cover the developer accumulation region I2. In this case, in the developer accumulation region I2, the gap between the developer storage compartment 43 and the transport member 430 is larger than the gap Y2 in FIG. 7, so developer builds up here. When developer builds up in the developer accumulation region I2 in the vicinity of the discharge port D, for example, there is a risk that while the shutter 435 is being moved so as to close the discharge port D, the built-up developer will scatter from the discharge port D to outside of the development apparatus 40. Moving the shutter 435 so as to close the discharge port D means that maintenance work has already been started, so it is not desirable for developer to leak from the discharge port D. As described above, it is possible to prevent this sort of situation by allowing developer to be discharged to move from the discharge port D to the outside of the development apparatus 40 without accumulating in the developer accumulation region I2.

MODIFIED EXAMPLES

The foregoing is a description of an exemplary embodiment of the invention, and the contents of this exemplary embodiment can be modified in the following manner. Also, the following modified examples may be appropriately combined.

Modified Example 1

In the above exemplary embodiment, the shutter 435 is provided with both a function to open/close the discharge port D and a function to open/close the opening portion O, but this is not a limitation. For example, the shutter 435 may only open/close the opening portion O.

Figure 8:
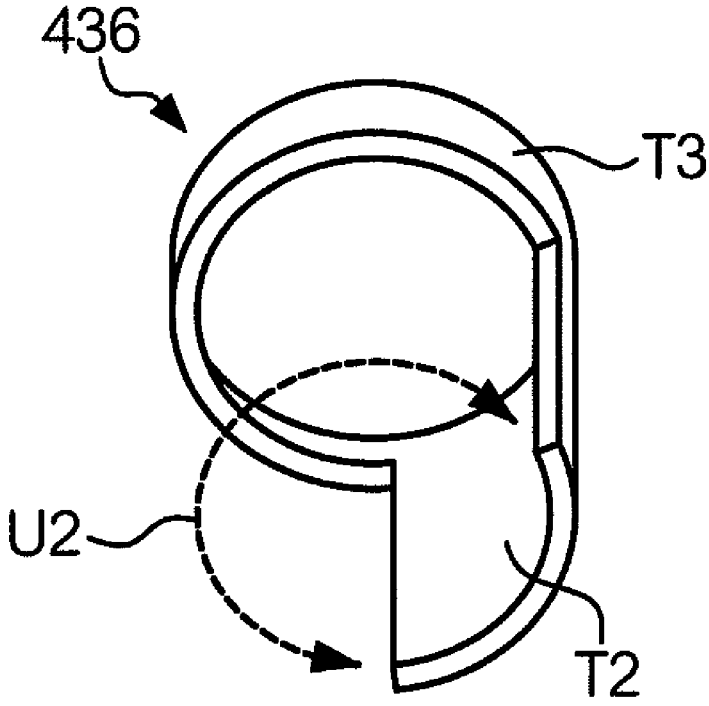
FIG. 8 is a perspective view that shows an example of a shutter according to a modified example of the first exemplary embodiment.

FIG. 8 is a perspective view that shows an example of a shutter 436 according to this modified example. As shown in FIG. 8, the shutter 436 is provided with a protruding portion T2 and a ring portion T3. That is, the shutter 436 lacks the protruding portion T1 of the shutter 435 shown in FIG. 4.

Figure 9:
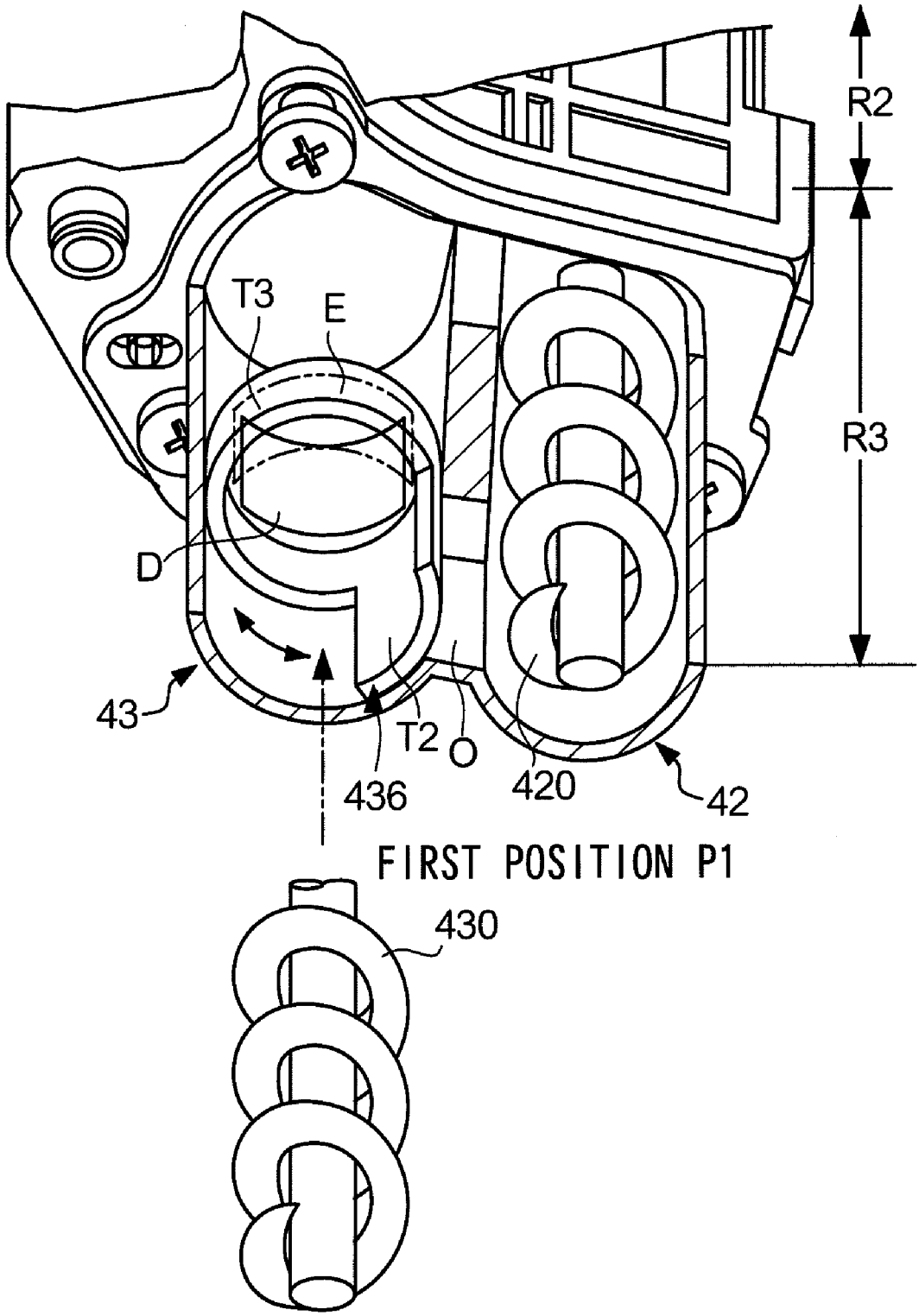
FIG. 9 shows the shutter in FIG. 8 when it is moved to a first position.
Figure 10:
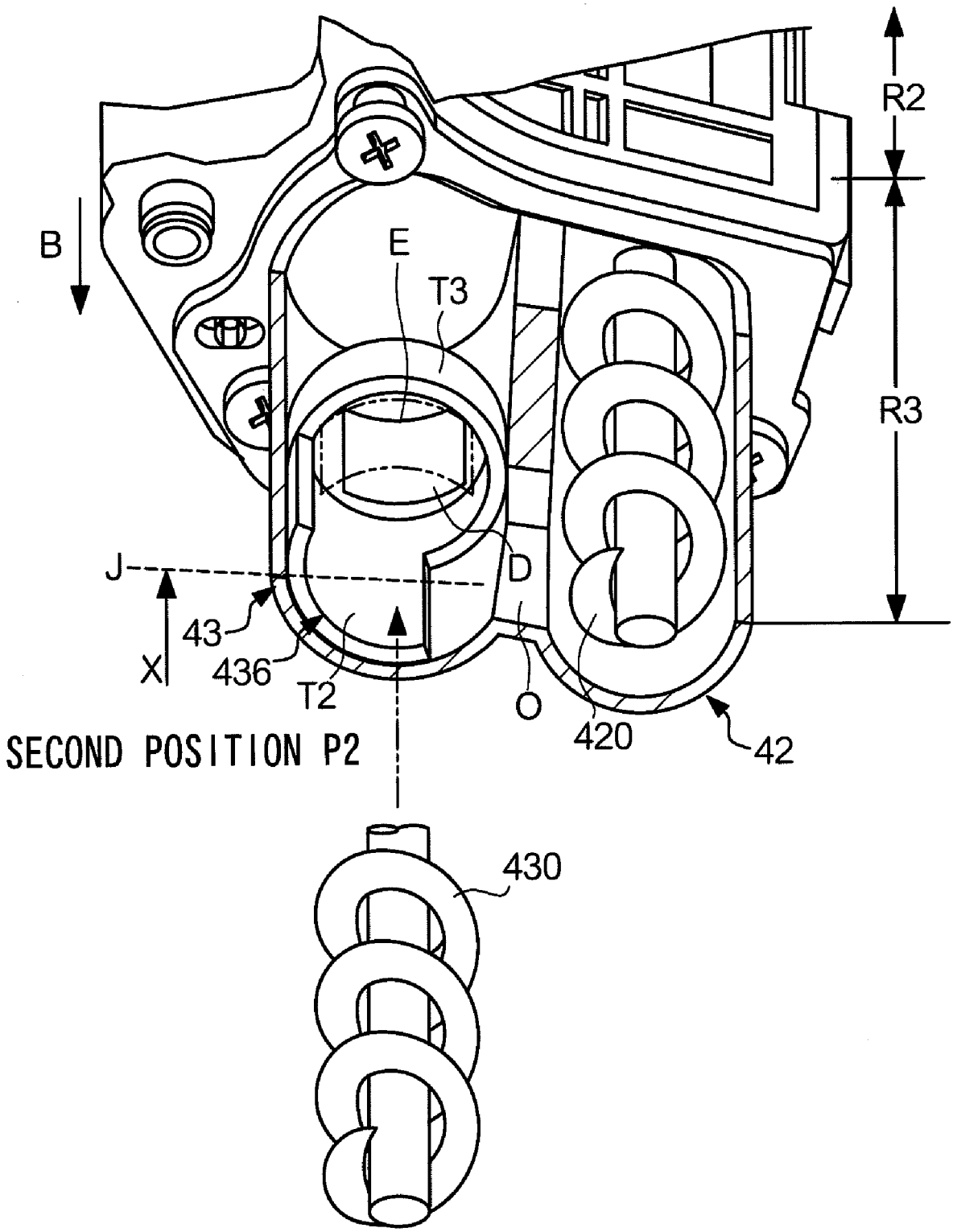
FIG. 10 shows the shutter in FIG. 8 when it is moved to a second position.

FIG. 9 shows the shutter 436 when it is moved to the first position P1. At this time, the protruding portion T2 of the shutter 436 is moved to a position where it covers the opening portion O, so the opening portion O is in a closed state facing toward the developer storage compartment 42. Thus, developer or other foreign matter does not enter from the developer storage compartment 43 via the opening portion O to the developer storage compartment 42. On the other hand, FIG. 10 shows the shutter 436 when it is moved to the second position P2. At this time, a cut-out portion U2 of the shutter 436 is disposed at a position where it overlaps the opening portion O, so the opening portion O is in an open state facing toward the developer storage compartment 42. Thus, developer that is supplied to the developer supply port E is allowed to move to the developer storage compartment 42 via the opening portion O. Note that the cut-out portion U2 is a configuration of the shutter 436 considered in the same manner as in the exemplary embodiment, and is a region where, viewed from the ring portion T3, the protruding portion T2 is not provided.

Figure 11:
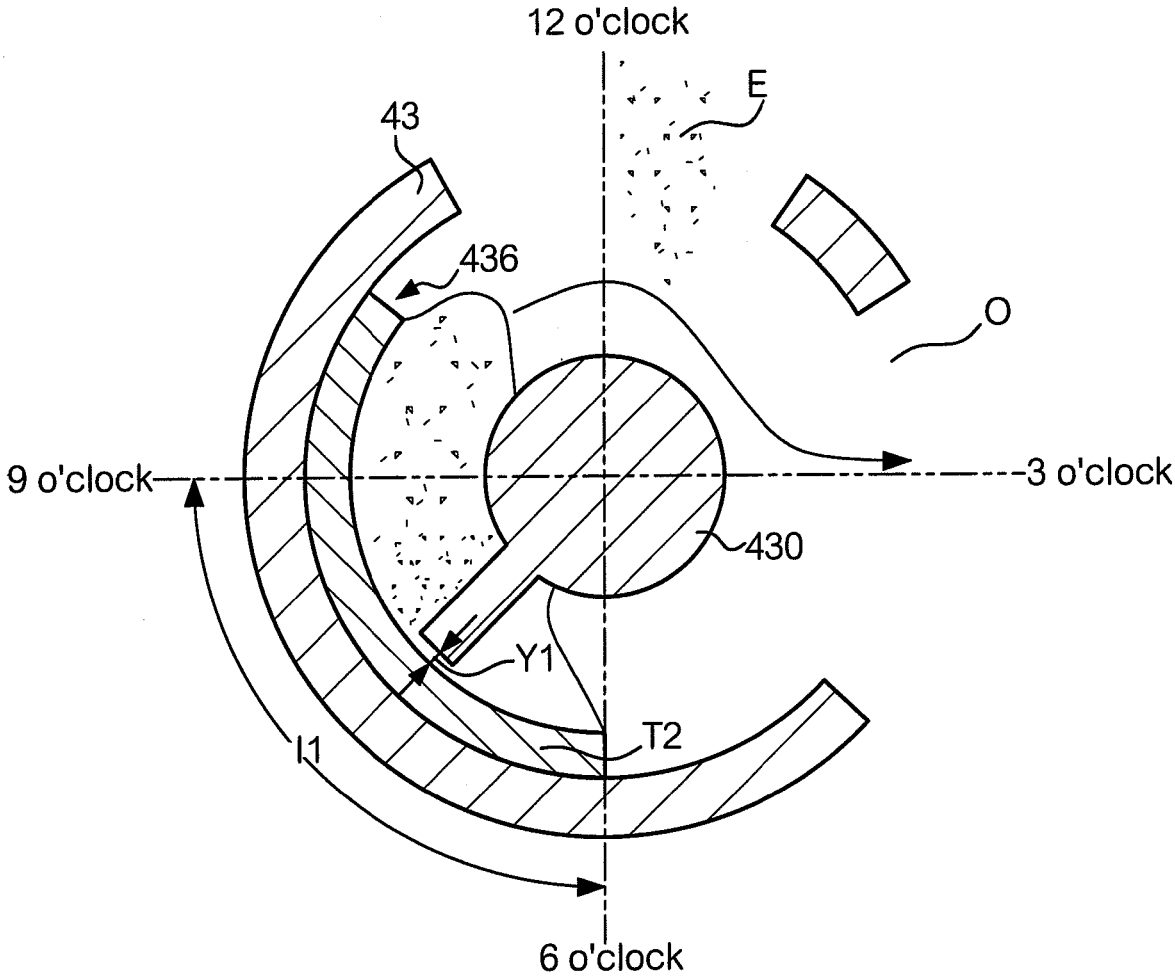
FIG. 11 illustrates an operation when the shutter in FIG. 8 is moved to the second position.

Next is a description of operation when the shutter 436 is moved to the second position P2 shown in FIG. 10, with reference to FIG. 11. FIG. 11 is a cross-sectional view in which the developer storage compartment 43 is viewed from the direction of arrow X at broken line J shown in FIG. 10. When the shutter 436 is moved to the second position P2, the protruding portion T2, same as the protruding portion T2 of the shutter 435 described above, is disposed so as to cover the developer accumulation region I1. Thus, in the developer accumulation region I1, in comparison to a case where the shutter 436 is not provided in such a position, a gap Y1 between the shutter 436, which forms the inner wall face of the developer storage compartment 43, and the transport member 430 is small. Thus, the space where developer supplied to the developer supply port E accumulates is eliminated, so it is possible to reduce the amount of that developer that accumulates, and as a result it is possible to allow developer to quickly move to the side of the opening portion O.

Modified Example 2

In the above exemplary embodiment, the shutter 435 opens/closes the discharge port D and the opening portion O, but this is not a limitation. For example, the shutter 435 may open/close the opening portion O and the developer supply port E.

Figure 12:
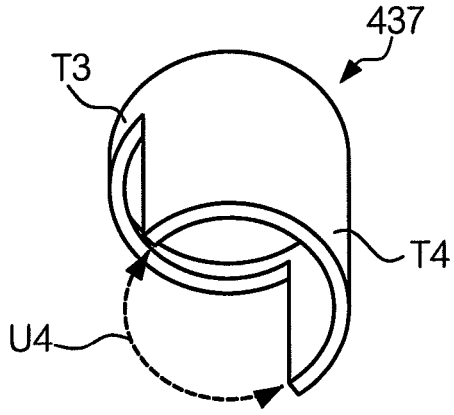
FIG. 12 is a perspective view that shows another example of the shutter according to a modified example of the first exemplary embodiment.

FIG. 12 is a perspective view that shows an example of a shutter 437 according to this modified example. As shown in FIG. 12, the shutter 437 is provided with a protruding portion T4 and a ring portion T3. The protruding portion T4 is at least as large as a region than spans from the opening portion O to the developer supply port E shown in FIG. 3, and a cut-out portion U4 has a size at least as large this region. Note that the cut-out portion U4 is a configuration of the shutter 437 considered in the same manner as in the exemplary embodiment, and is a region where, viewed from the ring portion T3, the protruding portion T4 is not provided.

Figure 13:
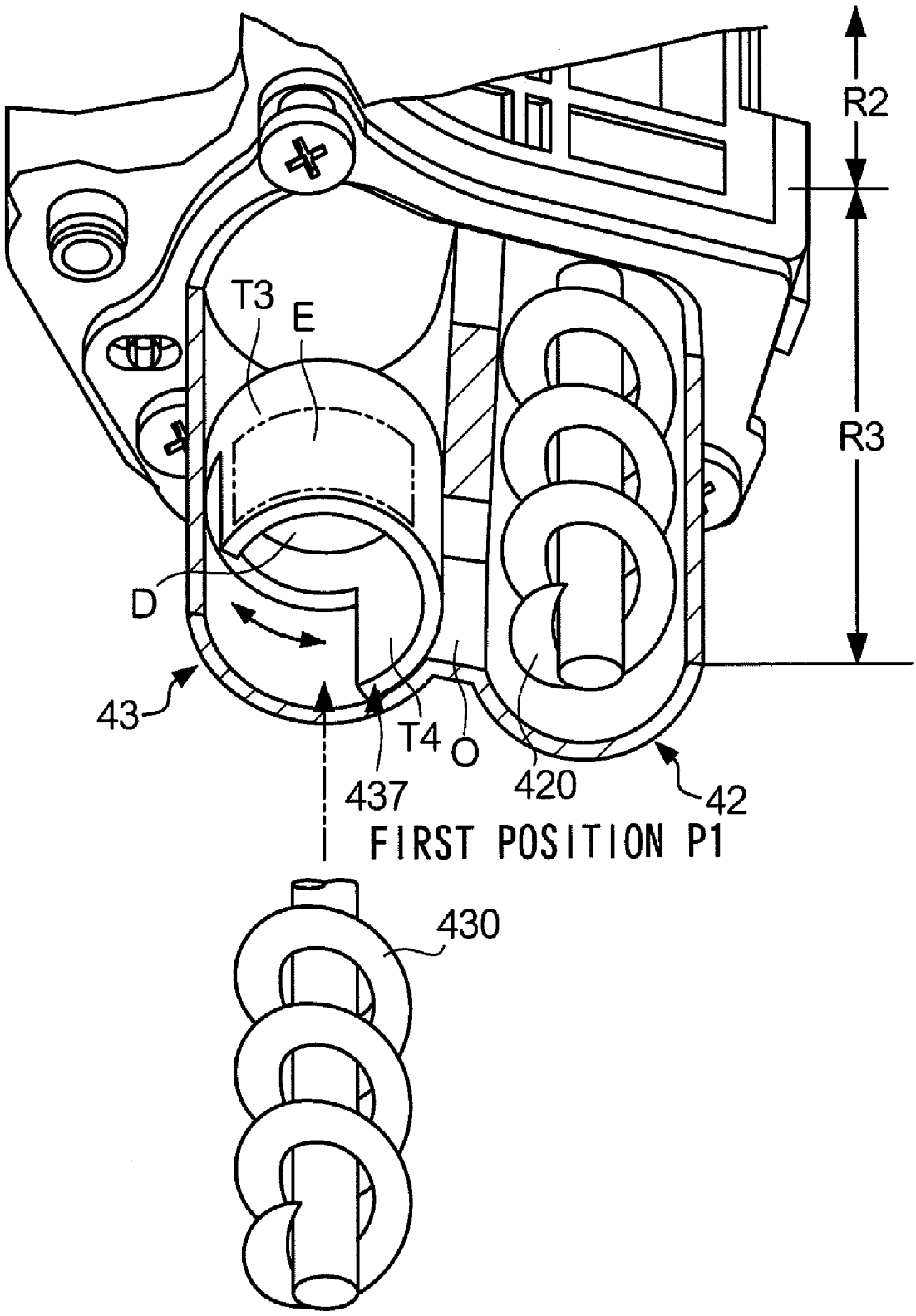
FIG. 13 shows the shutter in FIG. 12 when it is moved to a first position.
Figure 14:
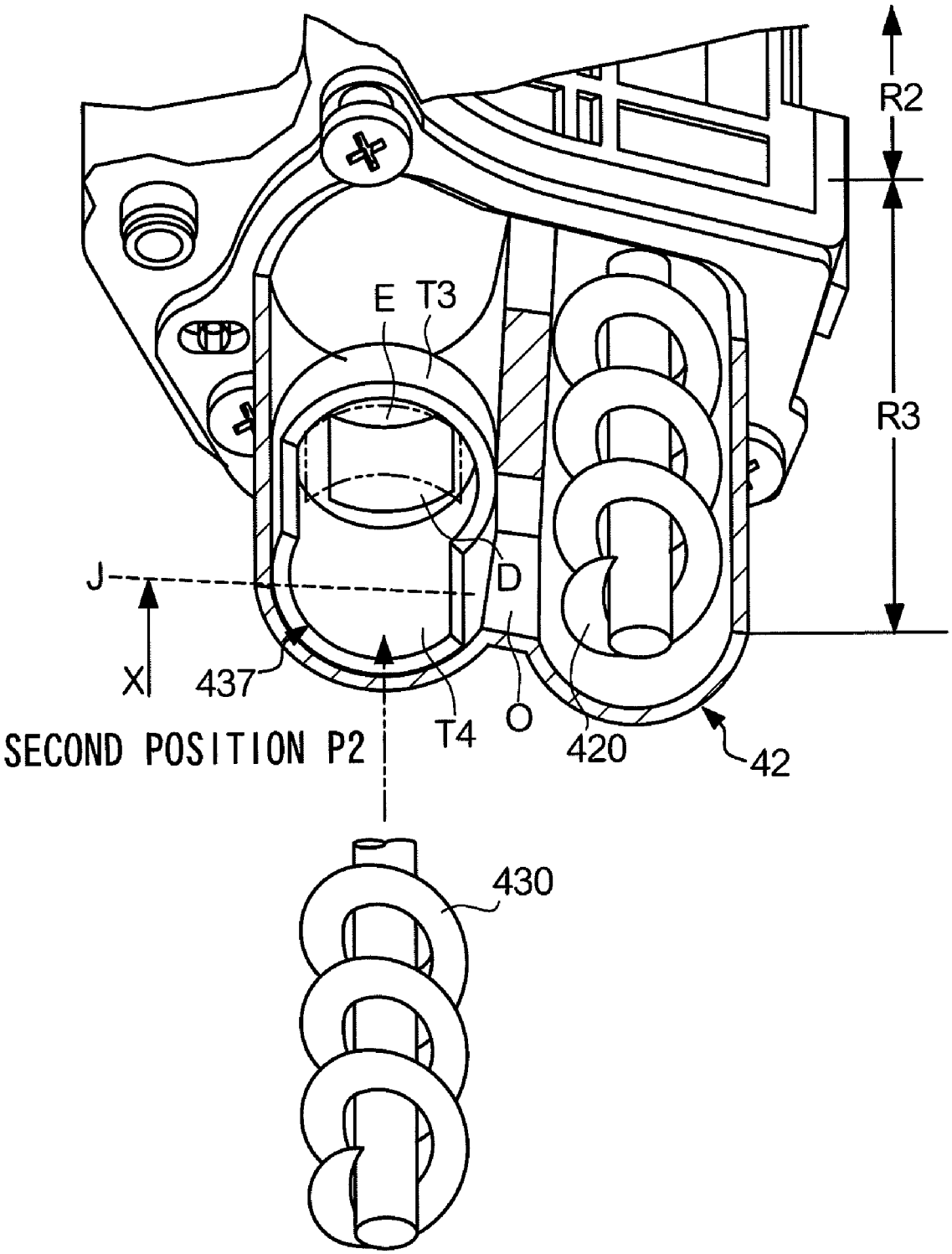
FIG. 14 shows the shutter in FIG. 12 when it is moved to a second position.

FIG. 13 shows the shutter 43 when it is moved to the first position P1. At this time, the protruding portion T4 of the shutter 437 is moved to a position where it covers the developer supply port E and the opening portion O, so the developer supply port E is in a closed state facing toward the outside of the development apparatus 40, and the opening portion O is in a closed state facing toward the developer storage compartment 42. Thus, developer or other foreign matter does not enter from the developer supply port E to the developer storage compartment 43, and developer or other extraneous matter does not enter from the developer storage compartment 43 via the opening portion O to the developer storage compartment 42. On the other hand, FIG. 14 shows the shutter 437 when it is moved to the second position P2. At this time, the cut-out portion U4 of the shutter 437 is disposed at a position where it overlaps the developer supply port E and the opening portion O, so the developer supply port E is in an open state facing toward the outside of the development apparatus 40, and the opening portion O is in an open state facing toward the developer storage compartment 42. Thus, developer supplied to the developer supply port E will be moved within the developer storage compartment 43, and this developer will be moved to the developer storage compartment 42 via the opening portion O.

Figure 15:
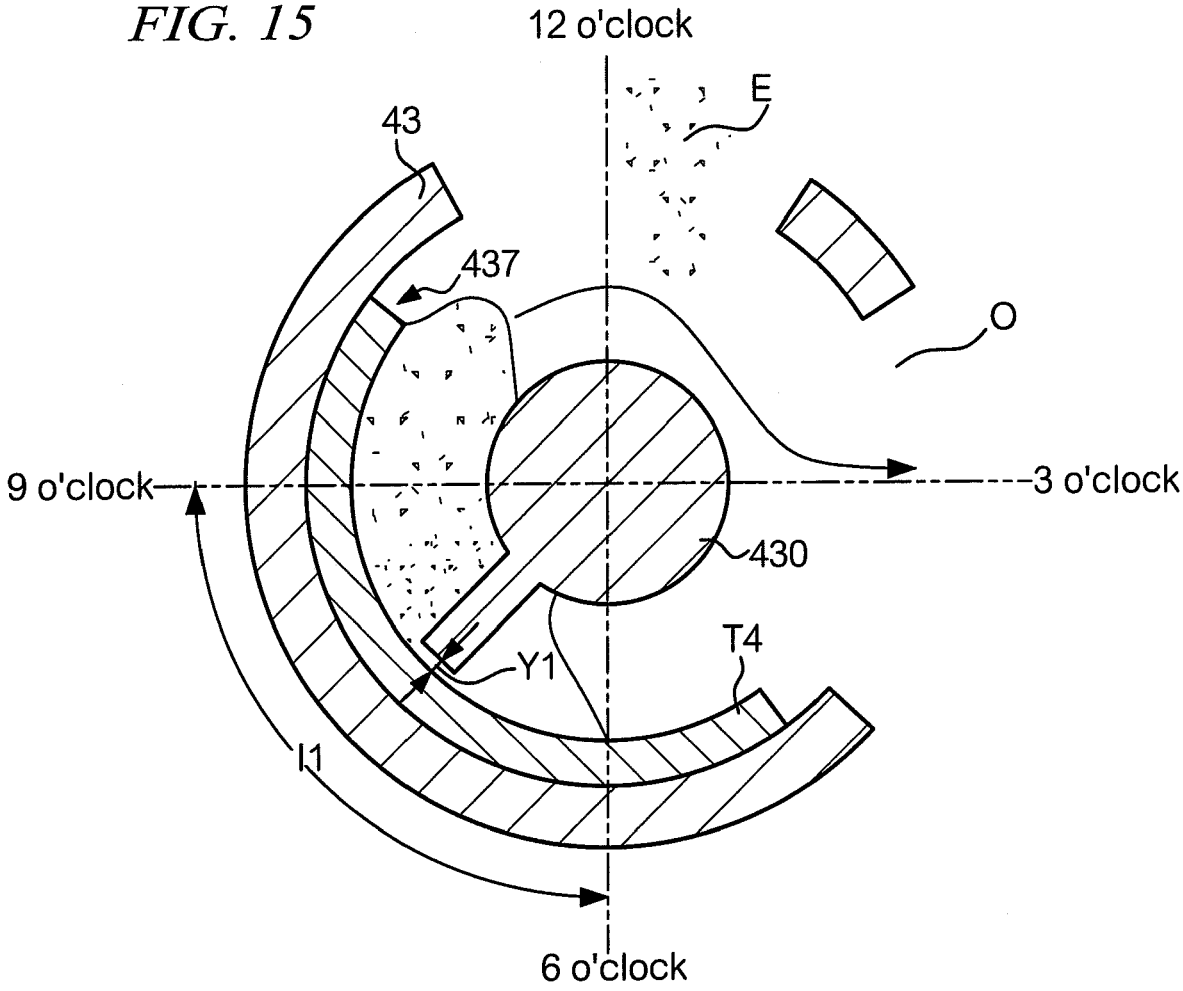
FIG. 15 illustrates an operation when the shutter in FIG. 12 is moved to the second position.

Next is a description of operation when the shutter 437 is moved to the second position P2 shown in FIG. 14, with reference to FIG. 15. FIG. 15 is a cross-sectional view in which the developer storage compartment 43 is viewed from the direction of arrow X at broken line J shown in FIG. 14. When the shutter 437 is moved to the second position P2, the protruding portion T4, same as the protruding portion T2 of the shutter 435 described above, is disposed so as to cover the developer accumulation region I1. Thus, in the developer accumulation region I1, in comparison to a case where the shutter 437 is not provided in such a position, a gap Y1 between the shutter 437, which forms the inner wall face of the developer storage compartment 43, and the transport member 430 is small. Thus, the space where developer supplied to the developer supply port E accumulates is eliminated, so it is possible to reduce the amount of that developer that accumulates, and as a result it is possible to allow developer to quickly move to the side of the opening portion O.

Modified Example 3

In the above exemplary embodiment, the area between the 6 o'clock direction and the 9 o'clock direction in FIG. 6 is set as the developer accumulation region I1, but this is not a limitation. For example, when the transport member 430 rotates in the counterclockwise direction in FIG. 6, the area between the 3 o'clock direction and the 6 o'clock direction in FIG. 6 is set as the developer accumulation region I1. The reason for this is that in the range of, viewed from the lowermost position in the storage space of the developer storage compartment 43, the downstream side in the direction of rotation of the transport member, and on the side below the center of rotation of the transport member in the direction of gravity, this is a region where force of the transport member to push up developer with rotation of the transport member opposes force of the developer to fall due to the operation of gravity, and developer easily accumulates. In other words, the developer accumulation region I1, viewed from the lowermost position within the developer storage compartment 43, is a region on the downstream side in the direction of rotation of the transport member 430, and on the side below the center of the transport member 430 in the direction of gravity. Thus, the shutter 435 is provided so as to cover the developer accumulation region I1 when the discharge port D is in an open state.

Modified Example 4

In the above exemplary embodiment, a case was described where the developer storage compartment 42 and the developer storage compartment 43 are in communication via the three opening portions O, P, and Q. On the other hand, in a case where the developer storage compartment 42 and the developer storage compartment 43 are in communication via only the two opening portions P and Q, the shutter may be provided so as to open/close the opening portion P.

Modified Example 5

In the above exemplary embodiment, adjacent to the developer storage compartment 42, the developer supply port E, the discharge port D, and the shutter 435 are provided in the developer storage compartment 43 that supplies developer to the development roller 41, but this is not absolutely necessary. The developer supply port E, the discharge port D, and the shutter 435 may be provided in the developer storage compartment 42. That is, as in the exemplary embodiment described above, the development roller 41 may perform development using developer supplied from a developer storage compartment (i.e. a second developer storage compartment) in which the developer supply port E, the discharge port D, and the shutter 435 are provided, or as in this modified example, the development roller 41 may perform development using developer supplied from a developer storage compartment (i.e. a first developer storage compartment) in which the developer supply port E, the discharge port D, and the shutter 435 are not provided.

Modified Example 6

In the exemplary embodiment described above, in the transport member 430, spiral blades are provided around a rotating shaft, but this is not a limitation. For example, the transport member 430 may be a so-called coil auger that does not have a rotating shaft, and is formed from a linear member in a coil-like shape. In other words, as long as the transport member 430 transports developer by rotating around a center of rotation, any configuration may be adopted.

2. Second Exemplary Embodiment

Following is a description of a second exemplary embodiment of the invention. The overall configuration of the image forming apparatus and the development apparatus of the second exemplary embodiment are the same as shown in FIGS. 1 and 2, so here a description thereof is omitted and mainly portions that differ from the first exemplary embodiment will be described. Note that the same reference numerals are given to the same members as in the first exemplary embodiment. In the second exemplary embodiment, a developer storage compartment 43*a* is used instead of the developer storage compartment 43.

Figure 16:
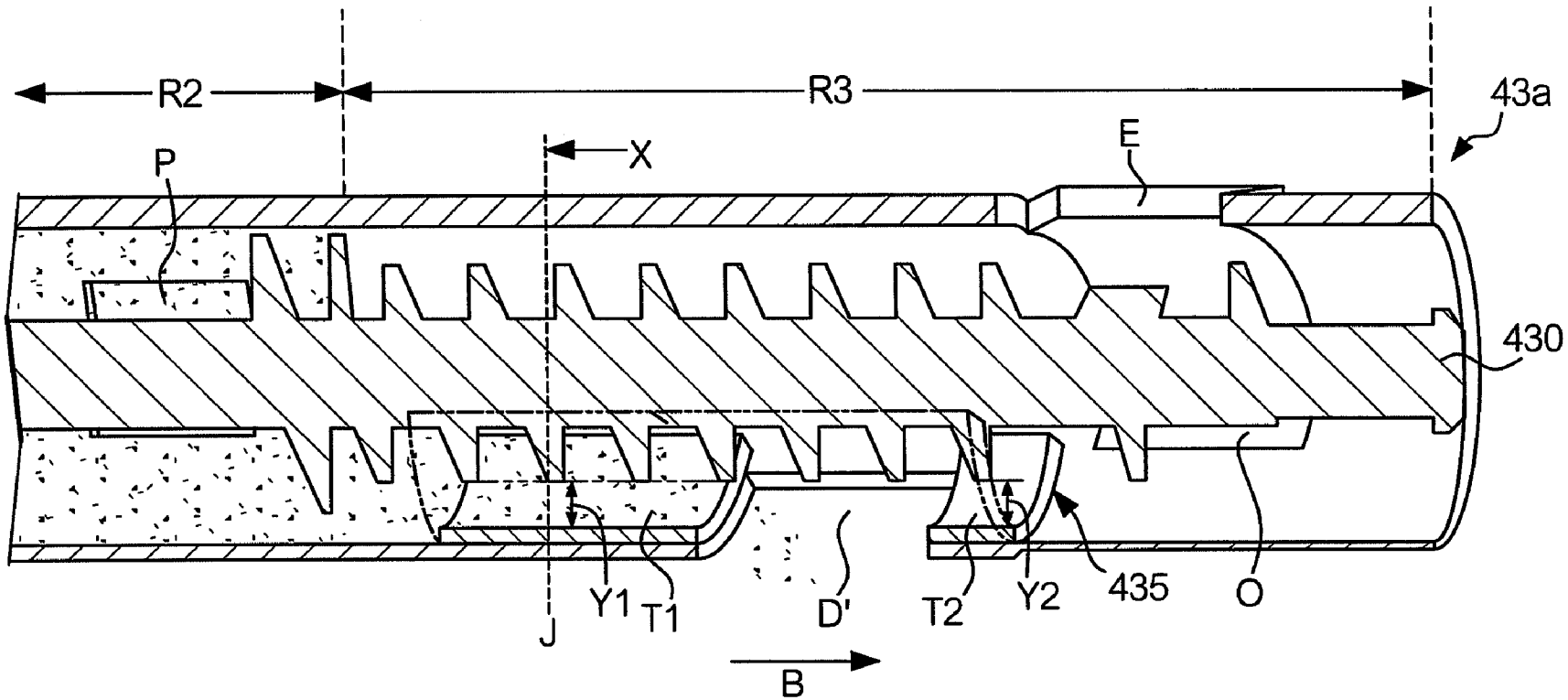
FIG. 16 is a cross-sectional view that shows a discharge region of a developer storage compartment according to a second exemplary embodiment.

FIG. 16 is a cross-sectional view of the discharge region R3 of the developer storage compartment 43*a*, viewed from direction H indicated in FIG. 2. As shown in FIG. 16, a developer supply port E is provided above the discharge region R3 of the developer storage compartment 43*a*, a discharge port D' is provided below, and also provided is a shutter 435*a* for opening and closing the discharge port D'. The developer supply port E is an opening portion that receives supply of developer from the developer supply unit 4Y. As shown in FIG. 16, the opening portion O described above is provided at a position on the side opposite to the side of the opening portion P when viewed from the position of the discharge port D', and allows the developer storage compartment 42 and the developer storage compartment 43*a* to be in communication. Developer that is supplied into the developer storage compartment 43*a* via the developer supply port E is directly pushed in the direction of the opening portion O by the transport member 430 that rotates, and moves to the developer storage compartment 42 via the opening portion O.

The discharge port D' is an opening portion where excess developer is discharged when the developer stored within the development apparatus 40 is at least a predetermined amount. The discharge port D' is provided at a position on the side opposite to the side of the opening portion Q when viewed from the position of the opening portion P. In the above-described accumulation region R2, when the developer stored within the development apparatus 40Y is at least a predetermined amount, the excess developer passes over developer that is pushed back by the transport member 430, and flows into the discharge region R3. Developer that has flowed into the discharge region R3 is transported in the direction of arrow B in FIG. 16 by the transport member 430, and discharged outside of the development apparatus 40Y from the discharge port D'.

The shutter 435*a* is provided along the inner wall face of the developer storage compartment 43*a*, and the thickness of the shutter 435*a* is such that the shutter 435*a* fits between the inner wall face of the developer storage compartment 43*a* and the outer edge of the blades of the transport member 430. That is, the shutter 435*a* serves the role of a first member that, due to being provided along the inner wall face of the developer storage compartment 43*a*, forms the inner wall face of the developer storage compartment 43*a*. Note that the double-dotted chained line in FIG. 16 indicates the shutter 435*a* at the front side of the paper face.

Figure 17:
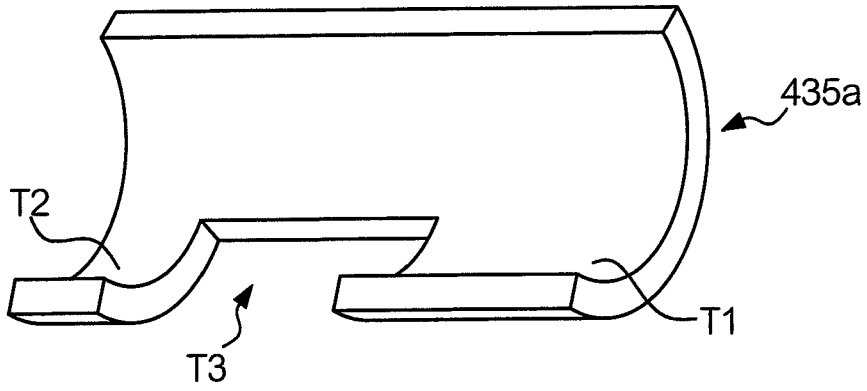
FIG. 17 is a perspective view that shows the shape of a shutter.

Here, FIG. 17 is a perspective view that shows the shape of the shutter 435*a* when viewed from the back side of the paper face in FIG. 16. As shown in FIG. 17, the shutter 435*a* is provided with a protruding portion T1 that is at least as large as the discharge port D', and a protruding portion T2, and has a cut-out portion T3 between the protruding portion T1 and the protruding portion T2 that is about the same size as the discharge port D'. While the development apparatus 40 is operating, the shutter 435*a* is moved to a second position where the cut-out portion T3 overlaps the discharge port D'. That is, the protruding portion T1 is disposed between the discharge port D' and the opening portion P, and the protruding portion T2 is disposed between the discharge port D' and the opening portion O. At this time, the discharge port D' is open facing toward the outside of the development apparatus 40, so excess developer is discharged from the opening portion O. On the other hand, for example, when an unshown lever is operated by an operator when performing maintenance work, the shutter 435*a* is moved in the direction of arrow B in FIG. 16 by a sliding mechanism or the like. At this time, the shutter 435*a* moves to the first position such that the protruding portion T1 covers the discharge port D', so the discharge port D' is closed facing toward the outside of the development apparatus 40. Thus, developer is not discharged from the discharge port D', and developer or other extraneous matter does not enter from outside via the discharge port D'.

Figure 18:
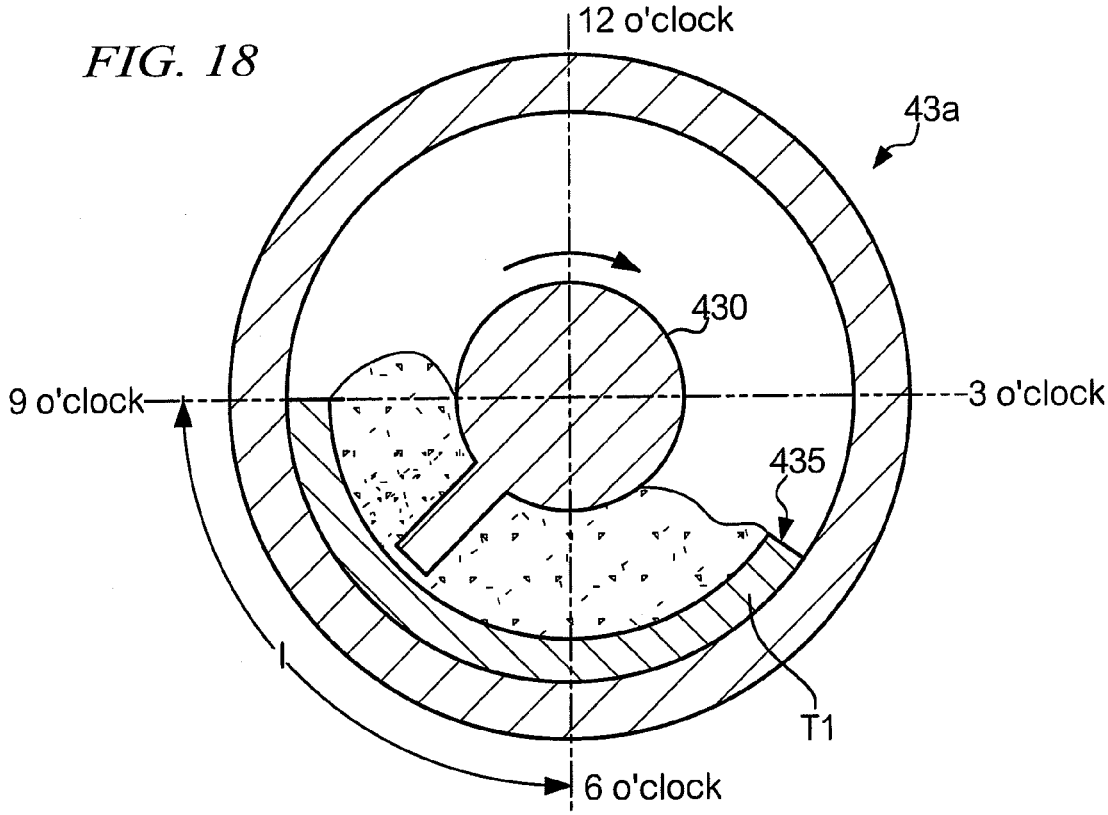
FIG. 18 is a cross-sectional view of a developer storage compartment.

FIG. 18 is a cross-sectional view in which the developer storage compartment 43*a* is viewed from the direction of arrow X at broken line J shown in FIG. 16. As shown in FIG. 18, the protruding portion T1 of the shutter 435*a* covers a developer accumulation region indicated by arrow I in FIG. 18. Same as the protruding portion T1, the protruding portion T2 also covers the developer accumulation region indicated by arrow I. This developer accumulation region indicates a position where developer easily accumulates when the transport member 430 is rotating clockwise in FIG. 18. Developer is transported by the transport member 430 from the back side to the front side in the direction perpendicular to the paper face of FIG. 18, but at this time, the transport member 430 rotates clockwise, so developer is transported while the blades of the transport member 430 move developer in the region on the right side in FIG. 18 toward the left. Thus, developer easily accumulates at the lower left side in the storage space of the developer storage compartment 43*a*, i.e., between the 6 o'clock direction and the 9 o'clock direction in FIG. 18. This developer accumulation region can be obtained by testing, by calculation, or the like.

Figure 19:
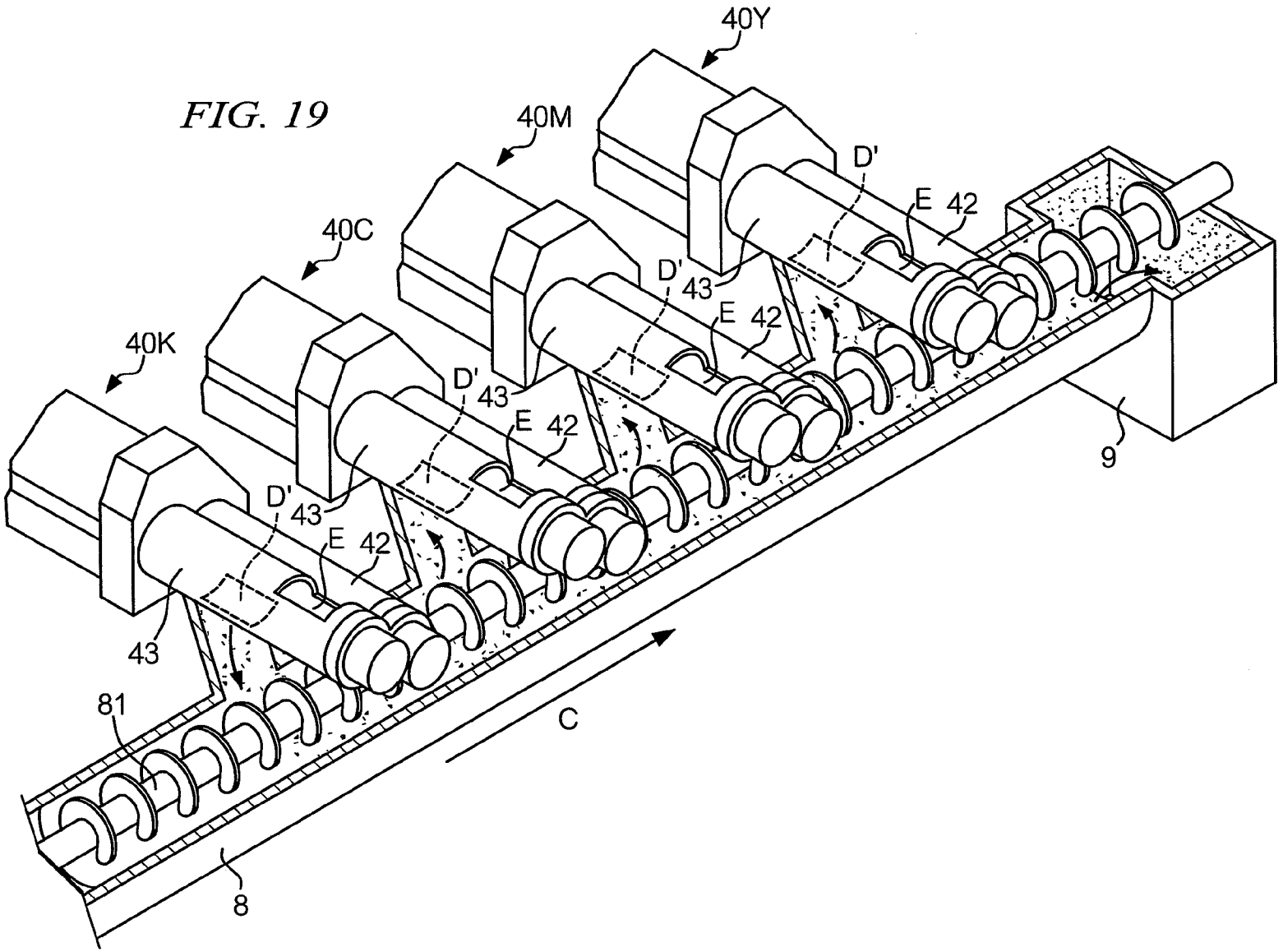
FIG. 19 shows a development apparatus viewed from above.

Here, a scheme for recovering developer that is discharged from the discharge port D' of respective development apparatuses 40 will be described. FIG. 19 shows development apparatuses 40Y, 40M, 40C, and 40K viewed from above. A recovery path 8 is provided ahead of the discharge port D' of the respective development apparatuses 40. Inside of this recovery path 8, a transport member 81 is provided in which spiral blades are provided around a rotating shaft. The transport member 81, due to being rotated by an unshown drive unit with the shaft center of the transport member 81 as the center of rotation, performs transport within the recovery path 8 in the direction of arrow C in FIG. 19. Developer that is discharged from the discharge port D' of the respective development apparatuses 40 flows out into the recovery path 8, and then is transported to a recovery/storage unit 9 by the transport member 81. Developer that is transported to the recovery/storage unit 9 is discarded as deteriorated developer.

For example, a case is assumed where a monochrome image is formed in the image forming apparatus 1. In this case, only the development apparatus 40K operates in order to perform development, and this is accompanied by excess K developer being discharged from the discharge port D' of the development apparatus 40K. K developer that is discharged from the discharge port D' of the development apparatus 40K flows out into the recovery path 8, and then is transported to the recovery/storage unit 9 by the transport member 81. However, part of this K developer may diverge from the recovery path 8 and move in the direction of the discharge port D' of the development apparatuses 40Y, 40M, and 40C. This is because when forming a monochrome image, the development apparatuses 40Y, 40M, and 40C are not operating, and there is no flow of developer from the respective discharge ports D' toward the recovery path 8. Developer that has moved in the direction of the discharge port D' of the development apparatuses 40Y, 40M, and 40C enters into the developer storage compartment 43*a* from the respective discharge ports D'. When, in this manner, developer of a different color that is discharged from another development apparatus 40 enters from the discharge port D', there is a risk that the developer of a different color will mix with the developer stored in the developer storage compartments 42 and 43. The shutter 435*a* provided in the developer storage compartment 43*a* of the respective development apparatuses 40 serves the role of preventing this mixing even when the discharge port D' is opened to the outside.

Next is a description of operation of the shutter 435*a* at this time, with reference again to FIG. 16. As described above, developer of a different color that has entered from the discharge port D' attempts to move to the developer storage compartment 42 from the opening portion O or the opening portion P via the gap between the developer storage compartment 43*a* and the transport member 430. However, as shown in FIG. 16, in the region that continues from the discharge port D' to the opening portion P, the gap Y1 between the developer storage compartment 43*a* and the transport member 430 is narrowed by the protruding portion T1 provided along the inner wall face of the developer storage compartment 43*a*. Also, in the region that continues from the discharge port D' to the opening portion O, the gap Y2 between the developer storage compartment 43*a* and the transport member 430 is narrowed by the protruding portion T2 provided along the inner wall face of the developer storage compartment 43*a*. In this way, in a region that is one part of the discharge region R3 between the discharge port D' and the opening portions P and O, the volume of the space between the developer storage compartment 43*a* and the transport member 430 is less than the volume in other regions within the discharge region R3, so it is difficult for developer that has entered from the discharge port D' to enter further from that region with less volume. Thus, it is possible to prevent, as much as possible, developer that has entered from the discharge port D' from entering the developer storage compartment 42 via the opening portion P or the opening portion O, and mixing with the developer used for development.

Also, when viewing a cross-section of the storage space of the developer storage compartment 43*a*, the protruding portions T1 and T2, as described above, are provided so as to cover the developer accumulation region, so in comparison to a case where this sort of configuration is not adopted, in this developer accumulation region, the volume of space between accumulated developer and the transport member 430 is reduced. Thus, the space where developer that has entered from the discharge port D' accumulates is eliminated, so it is difficult for that developer to accumulate within the developer storage compartment 43*a*.

MODIFIED EXAMPLES

The foregoing is a description of the second exemplary embodiment of the invention, and the contents of this exemplary embodiment can be modified in the following manner. Also, the following modified examples may be appropriately combined.

Modified Example 1

In the above exemplary embodiment, the shutter 435*a* moves in the direction of arrow B in FIG. 16, but the movement direction of the shutter 435*a* is not limited to that direction. For example, a configuration may be adopted in which when there is adequate space between the discharge port D' and the opening portion O, the shutter is moved in the direction opposite to the direction of arrow B in FIG. 16. In this case, the protruding portion T2 shown in FIG. 17 is at least as large as the discharge port D', and the protruding portion T2 covers the discharge port D'.

Alternatively, a configuration may be adopted in which the portion adjacent to the cut-out portion T3 of the shutter 435*a* shown in FIG. 17 is at least as large as the discharge port D', and when the shutter 435*a* is viewed from direction X in FIG. 16, is rotationally movable along the inner wall face of the developer storage compartment 43*a*. In this case, the discharge port D' can be covered by rotating the shutter 435*a* counterclockwise, and conversely, the discharge port D' can be opened by rotating the shutter 435*a* clockwise. In other words, any configuration may be adopted in which the shutter 435*a* is provided so as to be movable between a first position in which the discharge port D' is covered and a second position in which the discharge port D' is not covered.

Modified Example 2

In the above exemplary embodiment, the area between the 6 o'clock direction and the 9 o'clock direction indicated by arrow I in FIG. 18 is set as the developer accumulation region, but this is not a limitation. For example, a configuration can be adopted in which when the transport member 430 rotates in the counterclockwise direction in FIG. 18, the area between the 3 o'clock direction and the 6 o'clock direction in FIG. 18 is set as the developer accumulation region. The reason for this is that in the range of, viewed from the lowermost position in the storage space of the developer storage compartment 43*a*, the side of the direction of rotation of the transport member, developer easily accumulates. In other words, any configuration may be adopted in which, the developer accumulation region, viewed from the lowermost position within the developer storage compartment 43*a*, includes at least a range of the downstream side in the direction of rotation of the transport member 430, and the side in the perpendicular direction from the center of the developer storage compartment 43*a*. Also, any configuration may be adopted in which the shutter 435*a* is provided so as to cover this developer accumulation region.

Modified Example 3

In the above exemplary embodiment, a case is described in which the developer storage compartment 42 and the developer storage compartment 43*a* are in communication via the three opening portions O, P, and Q. On the other hand, in a case where the developer storage compartment 42 and the developer storage compartment 43*a* are in communication via two opening portions P and Q, a configuration may be adopted in which the shutter 435*a* is not provided with the protruding portion T2. This is because when the opening portion O is not provided, it is sufficient to narrow only the gap Y1 that is continuous from the discharge port D' to the opening portion P. With this configuration as well, same as in the exemplary embodiment described above, it is possible to make it difficult for developer that has entered from the discharge port D' of the development apparatus 40 to mix with developer stored within that development apparatus 40.

Modified Example 4

Figure 21:
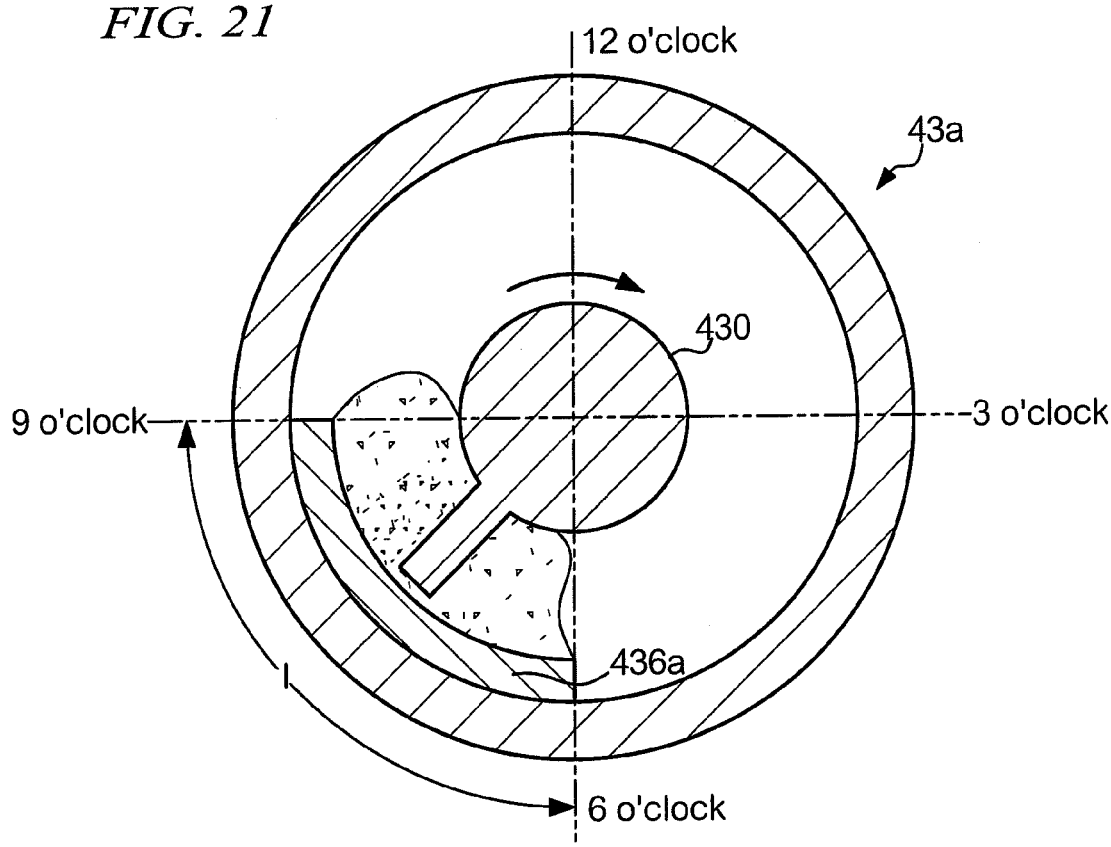
FIG. 21 is a cross-sectional view of a developer storage compartment according to a modified example of the second exemplary embodiment.
Figure 20:
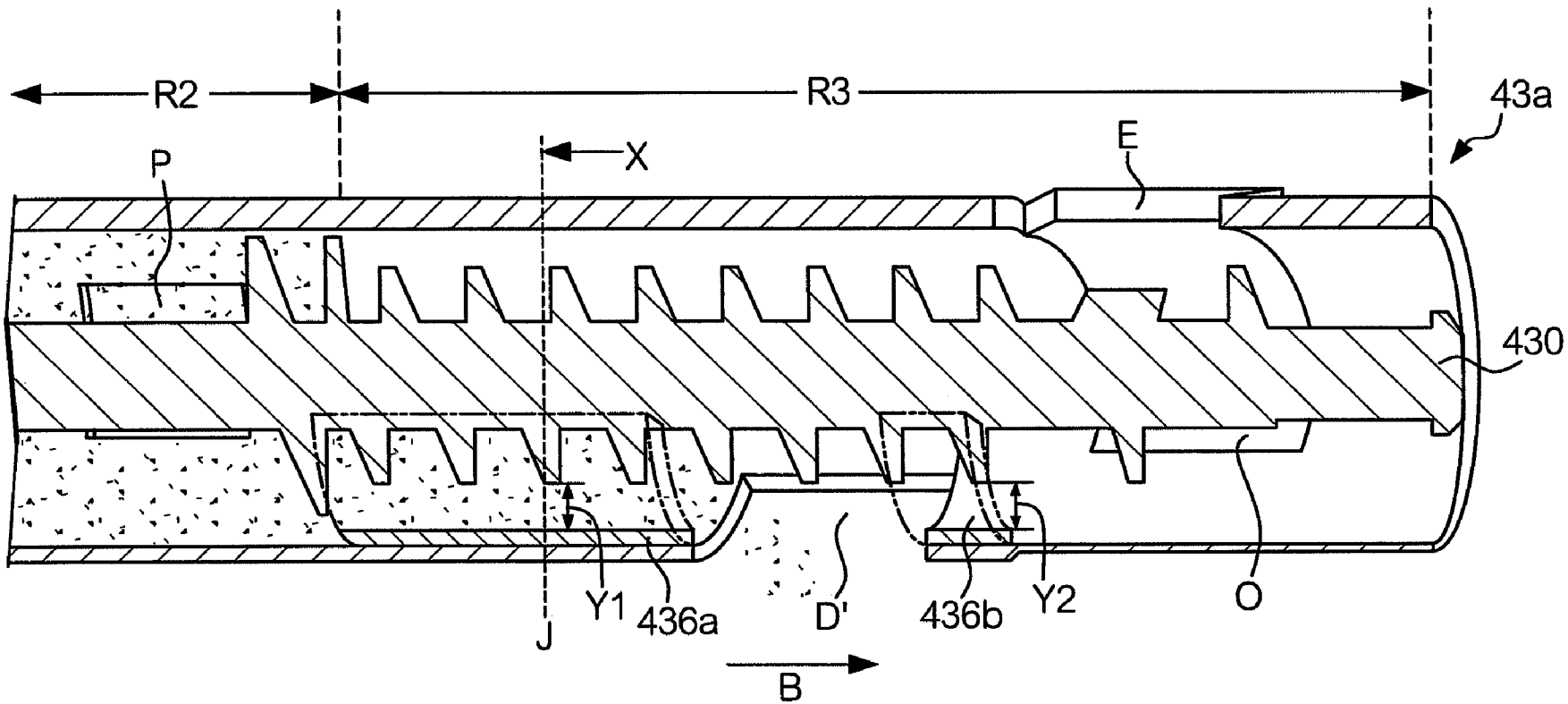
FIG. 20 shows an example of a plate-like member according to a modified example of the second exemplary embodiment.

In the exemplary embodiment described above, the shutter 435*a* is provided in the developer storage compartment 43*a*, but a configuration may also be adopted in which instead of the shutter 435*a*, in a region that is one part of the discharge region R3, a plate-like member is provided along the inner wall face of the developer storage compartment 43*a*. In this case, a configuration may be adopted in which the plate-like member is welded to the inner wall face of the developer storage compartment 43*a*, because it is not necessary for the plate-like member to move. FIG. 20 shows an example of plate-like members 436*a* and 436*b* according to this modified example, indicated in FIG. 20 by double-dotted chained lines. In FIG. 20, the plate-like member 436*a*, same as the protruding portion T1 described above, is disposed between the discharge port D' and the opening portion P, and the plate-like member 436*b*, same as the protruding portion T2 described above, is disposed between the discharge port D' and the opening portion O. That is, the plate-like member 436*a* and the plate-like member 436*b* are provided at facing positions sandwiching the discharge port D', so the discharge port D' is open toward the outside of the development apparatus 40. FIG. 21 is a cross-sectional view in which the developer storage compartment 43*a* is viewed from the direction of arrow X at broken line J shown in FIG. 20. As shown in FIG. 21, the plate-like member 436*a* is provided with exactly the width of the developer accumulation region indicated by arrow I in FIG. 21, so as to cover this developer accumulation region. The plate-like member 436*b*, same as the plate-like member 436*a*, also is provided with exactly the width of the developer accumulation region indicated by arrow I in FIG. 21, so as to cover this developer accumulation region. Also, in this modified example, the plate-like members 436*a* and 436*b* are not limited to the shape shown in FIGS. 20 and 21; for example, they may have a ring shape provided so as to follow the complete inner circumference of the inner wall face of the developer storage compartment 43*a*. With this configuration as well, it is possible to narrow the gap Y1 that continues from the discharge port D' to the opening portion P, and the gap Y2 that continues from the discharge port D' to the opening portion O.

Modified Example 5

Figure 22:
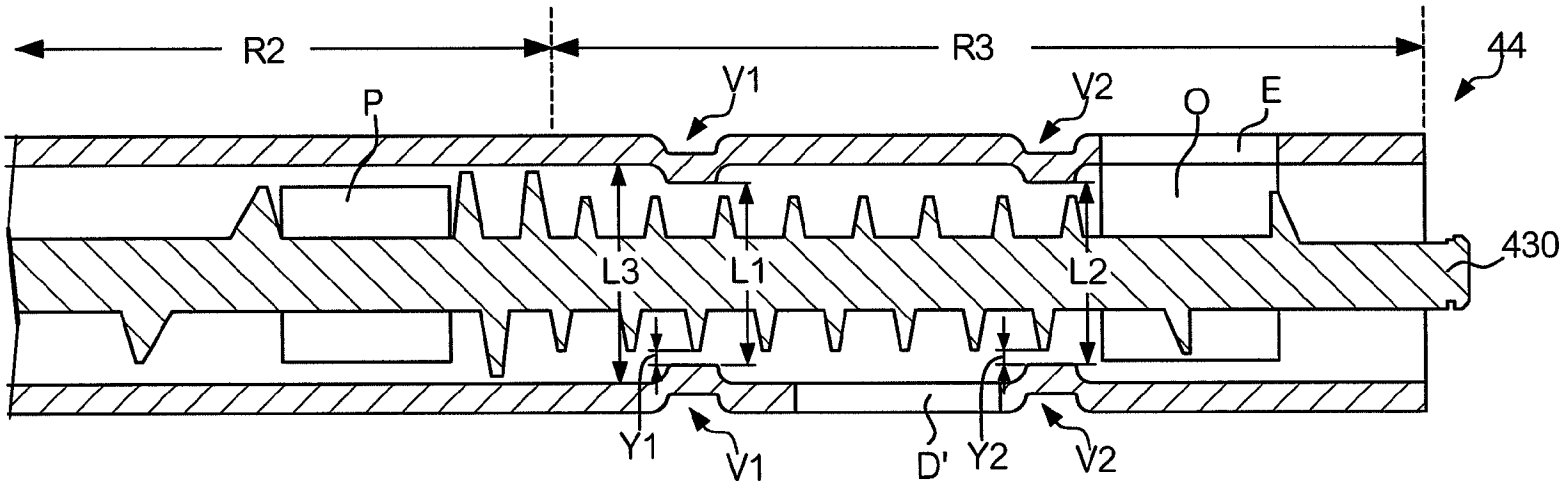
FIG. 22 shows an example of a developer storage compartment according to a modified example of the second exemplary embodiment.

In the above exemplary embodiment, the shutter 435*a* provided in the developer storage compartment 43*a* serves the role of preventing mixing of developer of a different color that has entered from the discharge port D'. However, the developer storage compartment 43*a* itself may serve this role. FIG. 22 shows an example of a developer storage compartment 44 according to this modified example. As shown in FIG. 22, in a region that is one part of the discharge region R3 of the developer storage compartment 44, indented portions V1 and V2 are provided indented to the side of the transport member 430 to an extent that they do not obstruct the transport member 430. The indented portion V1 is disposed between the discharge port D' and the opening portion P, and the indented portion V2 is disposed between the discharge port D' and the opening portion O. That is, the indented portion V1 and the indented portion V2 are provided at positions that sandwich the discharge port D'. Thus, in the discharge region R3 of the developer storage compartment 44, cross-sectional areas L1 and L2 in the perpendicular direction in the indented portions V1 and V2 are smaller than a cross-sectional area L3 in the perpendicular direction in a region other than the indented portions V1 and V2, so it is possible to narrow the gaps Y1 and Y2 that continue from the discharge port D' to the opening portions P and O. Also, in this modified example, a configuration may also be adopted in which in the discharge region R3 of the developer storage compartment 44, only an indented portion continuously indented from the indented portion V1 to the indented portion V2 is provided. With this configuration, it is possible to make it difficult for developer that has entered from the discharge port D' of the development apparatus 40 to mix with developer stored within the development apparatus 40, without adding a new member in the developer storage compartment.

Modified Example 6

In the above exemplary embodiment, the shutter 435*a* provided in the developer storage compartment 43*a* serves the role of preventing mixing of developer of a different color that has entered from the discharge port D'. However, the transport member 430 may serve this role. Next is a description of several examples of the configuration of the transport member 430 according to this modified example.

Figure 23:
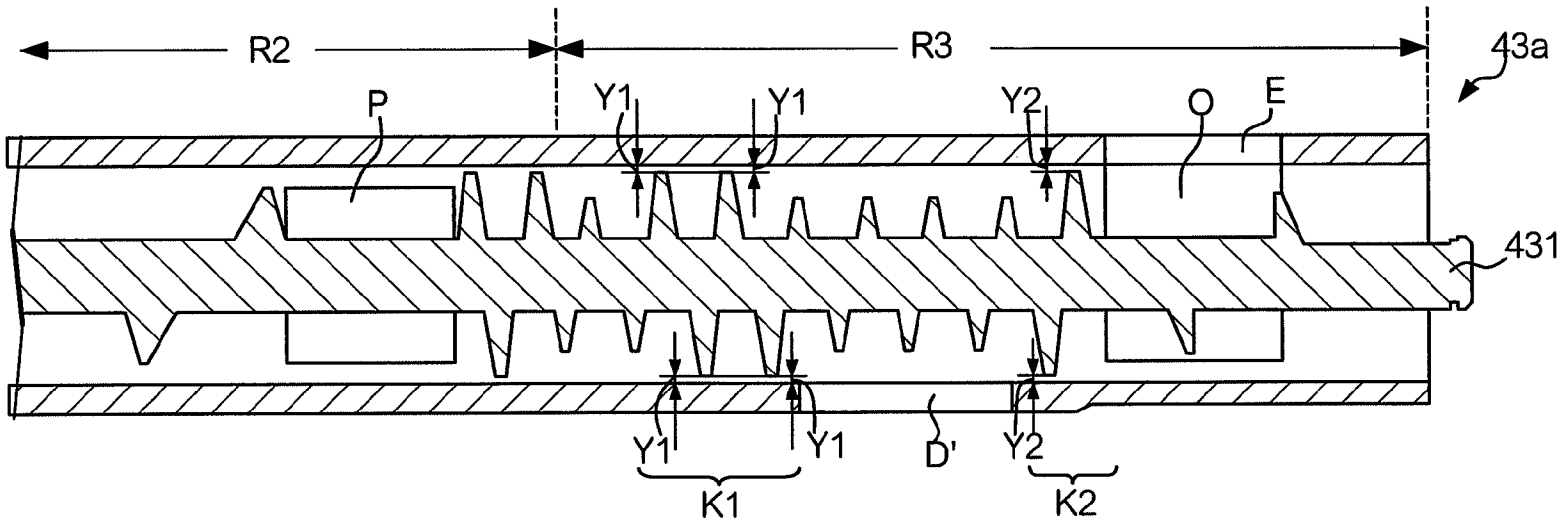
FIG. 23 shows an example of a transport member according to a modified example of the second exemplary embodiment.

FIG. 23 shows an example of a transport member 431 according to this modified example. As shown in FIG. 23, in the transport member 431, in a range K1 between the discharge port D' and the opening portion P, and a range K2 between the discharge port D' and the opening portion O, the diameter of the blades provided around the rotating shaft increases. Note that here, "between the discharge port D' and the opening portion P or the opening portion O" also includes a range that corresponds to the position where the discharge port D' is provided. Thus, in a region that is one part of the discharge region R3, it is possible to narrow the gap Y1 that continues from the discharge port D' to the opening portion P, and the gap Y2 that continues from the discharge port D' to the opening portion O. Also, in this modified example, in the transport member 431, the diameter of the blades may continuously increase from the range K1 to the range K2.

Figure 24:
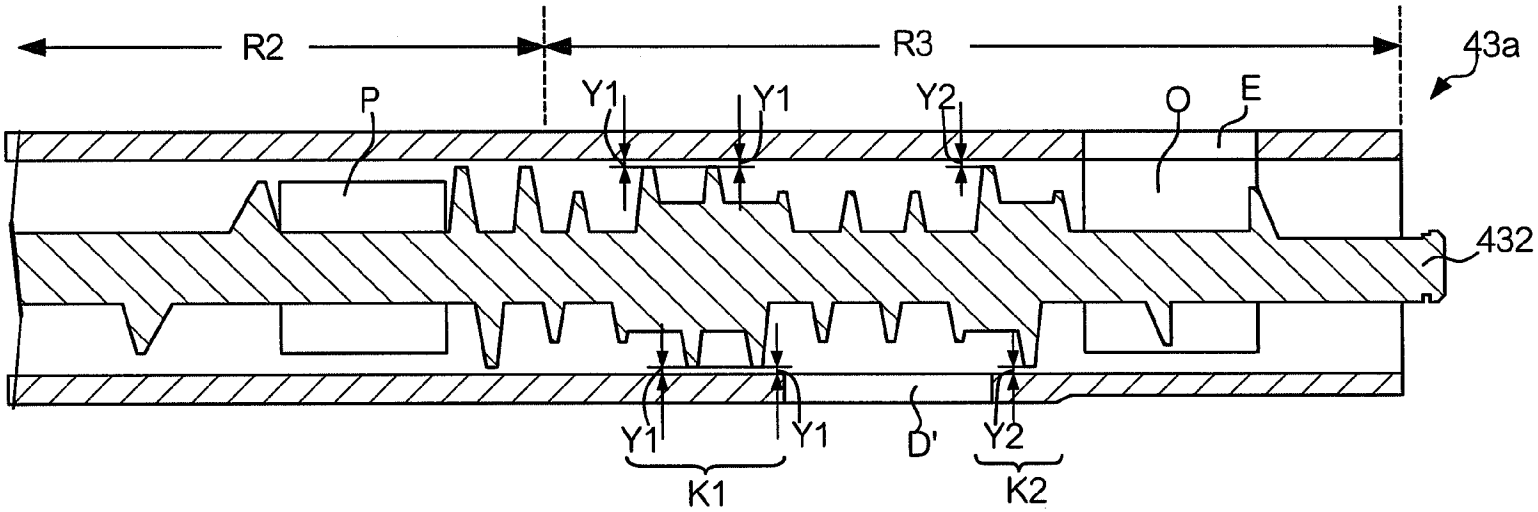
FIG. 24 shows an example of another transport member according to a modified example of the second exemplary embodiment.

FIG. 24 shows an example of a transport member 432 according to this modified example. As shown in FIG. 24, in the transport member 432, in a range K1 between the discharge port D' and the opening portion P, and a range K2 between the discharge port D' and the opening portion O, the diameter of the rotating shaft increases. Thus, in a region that is one part of the discharge region R3, it is possible to narrow the gap Y1 that continues from the discharge port D' to the opening portion P, and the gap Y2 that continues from the discharge port D' to the opening portion O. Also, in this modified example, in the transport member 432, the diameter of the rotating shaft may continuously increase from the range K1 to the range K2. In the examples shown in FIGS. 23 and 24, the outer diameter of the transport member in both the range K1 and the range K2 is larger than the outer diameter of the transport member in a range other than the ranges K1 and K2 within the discharge region R3, so the gaps Y1 and Y2 are narrowed.

Figure 25:
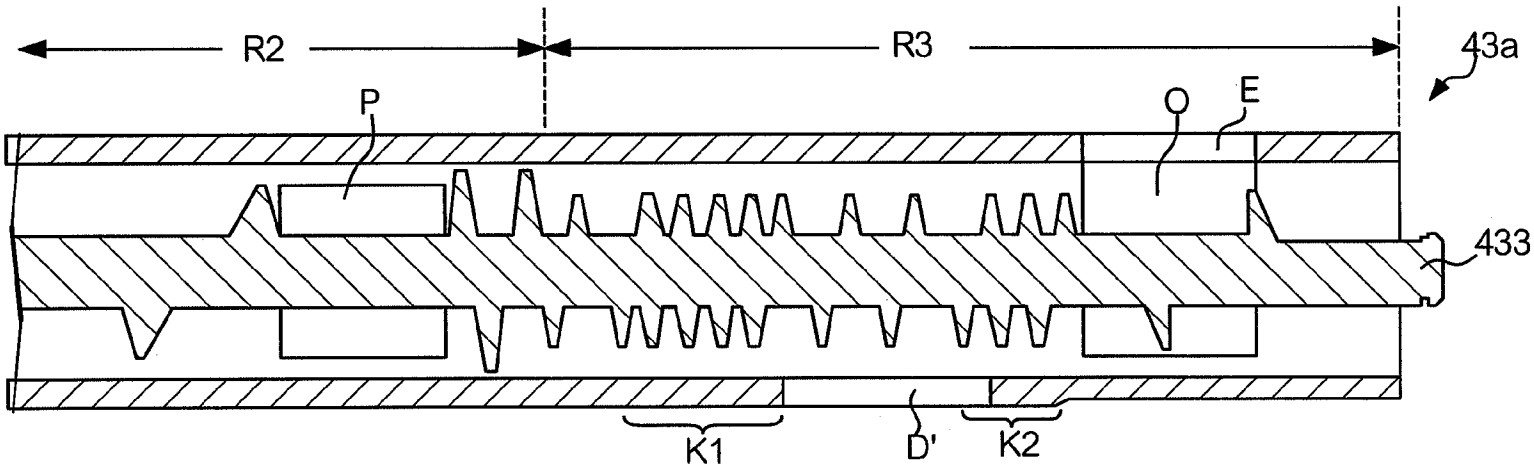
FIG. 25 shows an example of another transport member according to a modified example of the second exemplary embodiment.

FIG. 25 shows an example of a transport member 433 according to this modified example. As shown in FIG. 25, the transport member 433, in a range K1 between the discharge port D' and the opening portion P, and a range K2 between the discharge port D' and the opening portion O, the pitch of the spiral of the blades provided around the rotating shaft is shortened. Thus, in the ranges K1 and K2, the volume between the developer storage compartment 43*a* and the transport member 433 is reduced, and furthermore the transport force of the transport member 433 is reduced, so it is difficult for developer that has entered from the discharge port D' to move to the opening portion P or the opening portion O. Also, in this modified example, in the transport member 433, the pitch of the spiral of the blades may be shortened continuously from the range K1 to the range K2.

Figure 26:
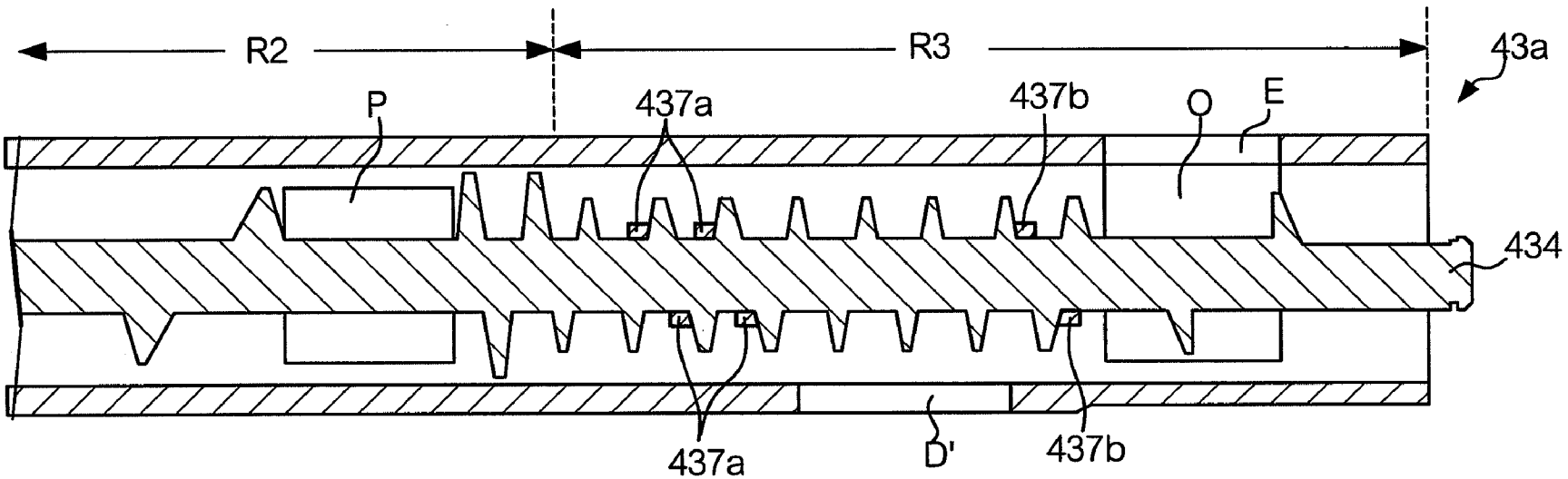
FIG. 26 shows an example of another transport member according to a modified example of the second exemplary embodiment.

FIG. 26 shows an example of a transport member 434 according to this modified example. As shown in FIG. 26, protruding members 437*a* and 437*b* are provided in the rotating shaft of the transport member 434, in the direction of the rotating shaft. The protruding members 437*a* are disposed between the discharge port D' and the opening portion P, and the protruding members 437*b* are disposed between the discharge port D' and the opening portion O. That is, the protruding members 437*a* and 437*b* serve the role of second members provided around the rotating shaft in a region that is one part of the discharge region R3. Thus, in the range where the protruding members 437*a* and 437*b* are provided, the volume between the developer storage compartment 43*a* and the transport member 434 is reduced, and furthermore the transport force of the transport member 434 is reduced, so it is difficult for developer that has entered from the discharge port D' to move to the opening portion P or the opening portion O. The shape of these protruding members 437*a* and 437*b* is not limited to the example shown in FIG. 26; any shape may be adopted as long as the protruding members 437*a* and 437*b* are provided around the rotating shaft, and reduce the volume between the developer storage compartment 43*a* and the transport member 434. Also, in this modified example, in the rotating shaft of the transport member 434, protruding members may be disposed continuously from the position where the protruding member 437*a* is disposed to the position where the protruding member 437*b* is disposed. Furthermore, these protruding members may be formed as a protrusion molded as a single body with the transport member as in this modified example, or they may be realized by installing members separate from the transport member.

With the configuration according to this modified example, by only changing the shape of the transport member provided inside of the developer storage compartment 43*a*, it is possible to make it difficult for developer that has entered from the discharge port D' of the development apparatus 40 to mix with developer stored within that development apparatus 40.

Modified Example 7

In the above exemplary embodiment, the discharge port D' is provided in the developer storage compartment 43*a*, which is adjacent to the developer storage compartment 42 and supplies developer to the development roller 41, but this is not absolutely necessary; the discharge port D' may be provided in the developer storage compartment 42. That is, as in the exemplary embodiment described above, the development roller 41 may perform development using developer supplied from a developer storage compartment (i.e. a second developer storage compartment) in which the discharge port D' is provided, or as in this modified example, the development roller 41 may perform development using developer supplied from a developer storage compartment (i.e. a first developer storage compartment) in which the discharge port D' is not provided.

Modified Example 8

In the exemplary embodiment described above, in the transport member 430, spiral blades are provided around a rotating shaft, but this is not a limitation. For example, the transport member 430 may be a so-called coil auger that does not have a rotating shaft, and is formed from a linear member in a coil-like shape. In other words, as long as the transport member 430 is provided with a spiral portion formed in a spiral shape that rotates around a center of rotation, any configuration may be adopted.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A development apparatus comprising:

a first developer storage container and a second developer storage container that store developer, the first developer storage container having a first opening and a second opening, so that the first developer storage container and the second developer storage container are in communication;

a first transport member that is provided within the first developer storage container, and that by rotating around a center of rotation, while transporting developer stored in the first developer storage container, causes the developer to move to the second developer storage container via the first opening;

a second transport member that is provided within the second developer storage container, and that by rotating around a center of rotation, while transporting developer stored in the second developer storage container, causes the developer to move to the first developer storage container via the second opening;

a developer holding member that holds developer supplied from the first developer storage container or the second developer storage container, and performs development by causing the developer to move to a position facing an image holding body on which a latent image is formed; and a moving member that is provided so as to fit between an inner wall face of the second developer storage container and an outer edge of the second transport member, and is moved between a first position where the second opening is covered and a second position where the second opening is not covered, and when moved to the second position, covers the inner wall face, viewed from the lowermost position in the second developer storage container, on the downstream side in the direction of rotation of the second transport member and on the side below the center of rotation of the second transport member in the direction of gravity, the moving member being positioned between the inner wall face and the outer edge when the moving member is moved to the first position and the second position.

2. The development apparatus according to claim 1, further comprising a discharge port that discharges a portion of the developer stored in the second developer storage container to outside of the development apparatus, wherein the moving member covers the discharge port along with the second opening when the moving member is moved to the first position.

3. The development apparatus according to claim 1, further comprising a developer supply port where developer is supplied from a developer supply source, wherein the moving member covers the developer supply port along with the second opening when the moving member is moved to the first position.

4. The development apparatus according to claim 1, further comprising a discharge port that is provided in the second developer storage container at, viewed from the position of the second opening, a position on the opposite side from the first opening, and discharges a portion of the developer stored in the second developer storage container to outside of the development apparatus, wherein:

a discharge region comprises a first portion between the discharge port and the second opening;

a space is provided along a developer transportation direction in the first portion of the discharge region;

the space includes subspaces each corresponding to a positional range in the developer transportation direction; and one of the subspaces is smaller than any of the other subspaces.

5. The development apparatus according to claim 4, wherein, the space in the first portion of the discharge region is a first space and the subspaces included in the first space are first subspaces, and wherein:

a third opening is provided at, viewed from the position of the discharge port, a position on the opposite side from the second opening, the third opening allowing the first developer storage container and the second developer storage container to be in communication; and the discharge region further comprising a second portion between the discharge port and the third opening, a second space is provided along a developer transportation direction in the second portion of the discharge region;

the second space includes second subspaces each corresponding to a positional range in the developer transportation direction; and one of the second subspaces is smaller than any of the other second subspaces.

6. The development apparatus according to claim 4, wherein in the second developer storage container, a cross-sectional area in the smaller subspace of the discharge region is less than a cross-sectional area in the other subspaces of the discharge region.

7. The development apparatus according to claim 4, wherein an outer diameter of the second transport member in the smaller subspace of the discharge region is larger than an outer diameter of the second transport member in the other subspaces of the discharge region.

8. The development apparatus according to claim 4, wherein:

the second transport member is provided with spiral blades provided around a center of rotation; and a pitch of the spiral of the blades in the smaller of the subspaces of the discharge region is shorter than a pitch of the spiral of the blades in the other subspaces of the discharge region.

9. The development apparatus according to claim 4, wherein:

the second transport member is provided with spiral blades provided around a center of rotation; and a second member that is provided around the center of rotation in the smaller subspace of the discharge region, so as to reduce the space in the smaller subspace.

10. An image forming apparatus, comprising:

an image holding member;

a charging unit that charges the surface of the image holding member;

an exposure unit that exposes the surface of the image holding member charged by the charging unit, thus forming a latent image;

a development apparatus comprising:

a first developer storage container and a second developer storage container that store developer, the first developer storage container having a first opening and a second opening, so that the first developer storage container and the second developer storage container are in communication;

a first transport member that is provided within the first developer storage container, and that by rotating around a center of rotation, while transporting developer stored in the first developer storage container, causes the developer to move to the second developer storage container via the first opening;

a second transport member that is provided within the second developer storage container, and that by rotating around a center of rotation, while transporting developer stored in the second developer storage container, causes the developer to move to the first developer storage container via the second opening;

a developer holding member that holds developer supplied from the first developer storage container or the second developer storage container, and performs development by causing the developer to move to a position facing an image holding body on which a latent image is formed; and a moving member that is provided so as to fit between an inner wall face of the second developer storage container and an outer edge of the second transport member, and is moved between a first position where the second opening is covered and a second position where the second opening is not covered, and when moved to the second position, covers the inner wall face, viewed from the lowermost position in the second developer storage container, on the downstream side in the direction of rotation of the second transport member and on the side below the center of rotation of the second transport member in the direction of gravity, a transfer unit that transfers an image developed by the development apparatus to a recording medium; and a fixing unit that fixes the image transferred to the recording medium by the transfer unit.

11. The image forming apparatus according to claim 10, wherein:

the development apparatus, further comprises a discharge port that discharges a portion of the developer stored in the second developer storage container to outside of the development apparatus; and the moving member covers the discharge port along with the second opening when the moving member is moved to the first position.

12. The image forming apparatus according to claim 10, wherein:

the development apparatus comprises a developer supply port where developer is supplied from a developer supply source; and the moving member covers the developer supply port along with the second opening when the moving member is moved to the first position.

13. The image forming apparatus according to claim 10, wherein:

the development apparatus comprises a discharge port that is provided in the second developer storage container at, viewed from the position of the second opening, a position on the opposite side from the first opening, and discharges a portion of the developer stored in the second developer storage container to outside of the development apparatus; and in a first portion of the discharge region between the discharge port and the second opening, the volume between the second developer storage container and the second transport member is less than the volume in other portions of the discharge region between the discharge port and the second opening.

14. The image forming apparatus according to claim 13, wherein:

a third opening is provided at, viewed from the position of the discharge port, a position on the opposite side from the second opening, the third opening allowing the first developer storage container and the second developer storage container to be in communication; and in a first portion of the discharge region between the discharge port and the third opening, the volume between the second developer storage container and the second transport member is less than the volume in other portions of the discharge region between the discharge port and the third opening.

15. The image forming apparatus according to claim 13, wherein in the second developer storage container, the cross-sectional area in the first portion of the discharge region is less than the cross-sectional area in the other portions of the discharge region between the discharge port and the second opening.

16. The image forming apparatus according to claim 13, wherein in the second transport member, the outer diameter in the first portion of the discharge region is larger than the outer diameter in the other portions of the discharge region between the discharge port and the second opening.

17. The image forming apparatus according to claim 13, wherein:

the second transport member is provided with spiral blades provided around a center of rotation; and the pitch of the spiral of the blades in the first portion of the discharge region is shorter than the pitch of the spiral of the blades in the other portions of the discharge region between the discharge port and the second opening.

18. The image forming apparatus according to claim 13, wherein:

the second transport member is provided with spiral blades provided around a center of rotation; and a second member that is provided around the center of rotation in the first portion of the discharge region, so as to reduce the space in the first portion of the discharge region.

19. A development apparatus, comprising:

a first developer storage container and a second developer storage container that store developer; the first developer storage container having a first opening and the second developer storage container having a second opening, so that the first developer storage container and the second developer storage container are in communication;

a first transport member that is provided within the first developer storage container, and while transporting developer stored in the first developer storage container, causes the developer to move to the second developer storage container via the first opening;

a second transport member that is provided within the second developer storage container, and while transporting developer stored in the second developer storage container, causes the developer to move to the first developer storage container via the second opening;

a discharge port that is provided in the second developer storage container at, viewed from the position of the second opening, a position on the opposite side from the first opening, and discharges a portion of the developer stored in the second developer storage container to outside of the development apparatus; and a developer holding body that holds developer supplied from the first developer storage container or the second developer storage container, and performs development by causing the developer to move to a position facing an image holding body on which a latent image is formed;

wherein the second developer storage container has a discharge region for discharging developer from the discharge port, the discharge region including the position where the discharge port is provided, and in a first portion of the discharge region between the discharge port and the second opening, the volume between the second developer storage container and the second transport member is less than the volume in portions of the discharge region other than the first portion of the discharge region between the discharge port and the second opening.

20. The development apparatus according to claim 19, wherein:

a third opening is provided at, viewed from the position of the discharge port, a position on the opposite side from the second opening, the third opening allowing the first developer storage container and the second developer storage container to be in communication; and in a second portion of the discharge region between the discharge port and the third opening, the volume between the second developer storage container and the second transport member is less than the volume in portions of the discharge region other than the second portion of the discharge region between the discharge port and the third opening.

21. The development apparatus according to claim 19, wherein in the second developer storage container, the cross-sectional area of the first portion of the discharge region is less than the cross-sectional area of the portions of the discharge region other than the first portion of the discharge region between the discharge port and the second opening.

22. The development apparatus according to claim 19, wherein in the second transport member, the outer diameter in the first portion of the discharge region is larger than the outer diameter in portions of the discharge region other than the first portion of the discharge region between the discharge port and the second opening.

23. The development apparatus according to claim 19, wherein:

the second transport member is provided with spiral blades provided around a center of rotation; and the pitch of the spiral of the blades in the first portion of the discharge region is shorter than the pitch of the spiral of the blades in portions of the discharge region other than the first portion of the discharge region between the discharge port and the second opening.

24. The development apparatus according to claim 19, wherein:

the second transport member is provided with spiral blades provided around a center of rotation; and a second member that is provided around the center of rotation in the first portion of the discharge region, so as to reduce the space in the first portion of the discharge region.

25. The development apparatus according to claim 1, wherein the moving member rotates along the inner wall face of the second developer container.

26. The development apparatus according to claim 10, wherein the moving member rotates along the inner wall face of the second developer container.

27. The development apparatus according to claim 19, wherein a third opening is provided in the second developer storage container between the first opening and the discharge port in the developer transportation direction which allows the first developer storage container and the second developer storage container to be in communication, and wherein the discharge region extends from the third opening to the second opening.

28. The development apparatus according to claim 4, wherein the first portion of the discharge region located between the discharge port and the second opening in a developer transportation direction, and a cross-sectional area, taken in a direction which is perpendicular to the developer transportation direction, between the second developer storage container and the second transport member, at the smaller subspace of the discharge region is less than a cross-sectional area, taken in the perpendicular direction, between the second developer storage container and the second transport member, at the other subspaces of the discharge region.

* * * * *